US011429035B2

(12) United States Patent
Yagi

(10) Patent No.: US 11,429,035 B2
(45) Date of Patent: Aug. 30, 2022

(54) LIGHT EMITTING DEVICE AND EXPOSURE DEVICE

(71) Applicant: FUJIFILM Business Innovation Corp., Tokyo (JP)

(72) Inventor: Kyoji Yagi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/308,343

(22) Filed: May 5, 2021

(65) Prior Publication Data

US 2022/0128922 A1 Apr. 28, 2022

(30) Foreign Application Priority Data

Oct. 28, 2020 (JP) ..... JP2020-180934

(51) Int. Cl.
*G03G 15/043* (2006.01)
*G03G 15/04* (2006.01)

(52) U.S. Cl.
CPC ..... *G03G 15/043* (2013.01); *G03G 15/04036* (2013.01); *G03G 15/04054* (2013.01)

(58) Field of Classification Search
CPC ..... G03G 15/043; G03G 15/04036; G03G 15/04054
See application file for complete search history.

(56) References Cited

U.S. PATENT DOCUMENTS 8,947,486 B2 2/2015 Tsuchiya
2003/0142371 A1* 7/2003 Hanabusa ..... H04N 1/00082 358/475
2011/0242264 A1* 10/2011 Kubota ..... B41J 2/451 347/258
2012/0194629 A1* 8/2012 Tsuchiya ..... B41J 2/45 347/225

(Continued)

FOREIGN PATENT DOCUMENTS

JP 2012-166541 A 9/2012

*Primary Examiner* — Carla J Therrien
(74) *Attorney, Agent, or Firm* — Sughrue Mion, PLLC

(57) ABSTRACT

A light emitting device includes: a first light-emitting-element row that includes light emitting elements arranged in a row in a main scanning direction; a second light-emitting-element row that includes light emitting elements arranged in a row in the main scanning direction and that is positioned in such a manner that at least a portion of the second light-emitting-element row overlaps the first light-emitting-element row in a subscanning direction; and a light-emission control unit that switches a light-emitting-element row caused to emit light between the first light-emitting-element row and the second light-emitting-element row at a switching point that is set at a position in an overlapping portion in which the first light-emitting-element row and the second light-emitting-element row overlap each other. The light-emission control unit sequentially turns on the light emitting elements in the overlapping portion in the order in which the light emitting elements are arranged and sets a direction in which the light emitting elements are (Continued)

sequentially turned on in the first light-emitting-element row and a direction in which the light emitting elements are sequentially turned on in the second light-emitting-element row to be the same as each other.

8 Claims, 15 Drawing Sheets

(56) References Cited

U.S. PATENT DOCUMENTS

2012/0320435 A1* 12/2012 Horiuchi ..... G03G 15/043
358/475
2017/0090338 A1* 3/2017 Yokoi ..... G03G 15/043

* cited by examiner

LIGHT EMITTING DEVICE AND EXPOSURE DEVICE

CROSS-REFERENCE TO RELATED APPLICATIONS

This application is based on and claims priority under 35 USC 119 from Japanese Patent Application No. 2020-180934 filed Oct. 28, 2020.

BACKGROUND

(i) Technical Field

The present disclosure relates to a light emitting device and an exposure device.

(ii) Related Art

In an image forming apparatus, such as a printer, a copying machine, or a facsimile machine, that employs an electrophotographic system, image formation is performed by in the following manner. An optical recording unit radiates image information onto a charged photoconductor, so that an electrostatic latent image is obtained. Then, the electrostatic latent image is visualized with a toner and transferred and fixed onto a recording medium. As such an optical recording unit, in the related art, an optical recording unit that uses a light-emitting element head formed by arranging a large number of light emitting elements such as light emitting diodes (LEDs) in a main scanning direction is employed as well as an optical recording unit that employs an optical scanning system for performing light exposure by using a laser to cause a laser beam to scan in a main scanning direction.

Japanese Unexamined Patent Application Publication No. 2012-166541 describes a light-emitting element head that includes a light emitting unit including a first light-emitting-element row that is formed of light emitting elements arranged in a line in a main scanning direction and a second light-emitting-element row that is formed of light emitting elements arranged in a line in the main scanning direction and that is disposed such that at least a portion of the second light-emitting-element row overlaps the first light-emitting-element row in a subscanning direction and a rod lens array used for forming an electrostatic latent image by focusing the light outputs of the light emitting elements and exposing a photoconductor to light. In a portion in which the first light-emitting-element row and the second light-emitting-element row overlap each other, the light emitting elements of the second light-emitting-element row are arranged at a pitch different from the pitch of the light emitting elements of the first light-emitting-element row.

SUMMARY

However, it is difficult to form a light-emitting element head in which all the light emitting elements are arranged in a main scanning direction on a single substrate. Consequently, a method may sometimes be employed in which a plurality of substrates are arranged in a staggered manner in a main scanning direction so as to partially overlap each other in a subscanning direction and in which the light emitting elements that are to be caused to emit light are switched in a portion in which the substrates overlap each other. In this case, however, an image may sometimes become misaligned in the subscanning direction at a switching point, at which switching of the light emitting elements is performed, and is printed.

Aspects of non-limiting embodiments of the present disclosure relate to providing a light emitting device and the like in which an image is less likely to become aligned in a subscanning direction at a switching point, at which switching of light emitting elements is performed, and is printed compared with the case where the light emitting elements are turned on in different directions in an overlapping portion.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a light emitting device including: a first light-emitting-element row that includes light emitting elements arranged in a row in a main scanning direction; a second light-emitting-element row that includes light emitting elements arranged in a row in the main scanning direction and that is positioned in such a manner that at least a portion of the second light-emitting-element row overlaps the first light-emitting-element row in a subscanning direction; and a light-emission control unit that switches a light-emitting-element row caused to emit light between the first light-emitting-element row and the second light-emitting-element row at a switching point that is set at a position in an overlapping portion in which the first light-emitting-element row and the second light-emitting-element row overlap each other. The light-emission control unit sequentially turns on the light emitting elements in the overlapping portion in the order in which the light emitting elements are arranged and sets a direction in which the light emitting elements are sequentially turned on in the first light-emitting-element row and a direction in which the light emitting elements are sequentially turned on in the second light-emitting-element row to be the same as each other.

BRIEF DESCRIPTION OF THE DRAWINGS

An exemplary embodiment of the present disclosure will be described in detail based on the following figures, wherein.

DETAILED DESCRIPTION

Description of Overall Configuration of Image Forming Apparatus

An exemplary embodiment of the present disclosure will be described in detail below with reference to the accompanying drawings.

Figure 1:
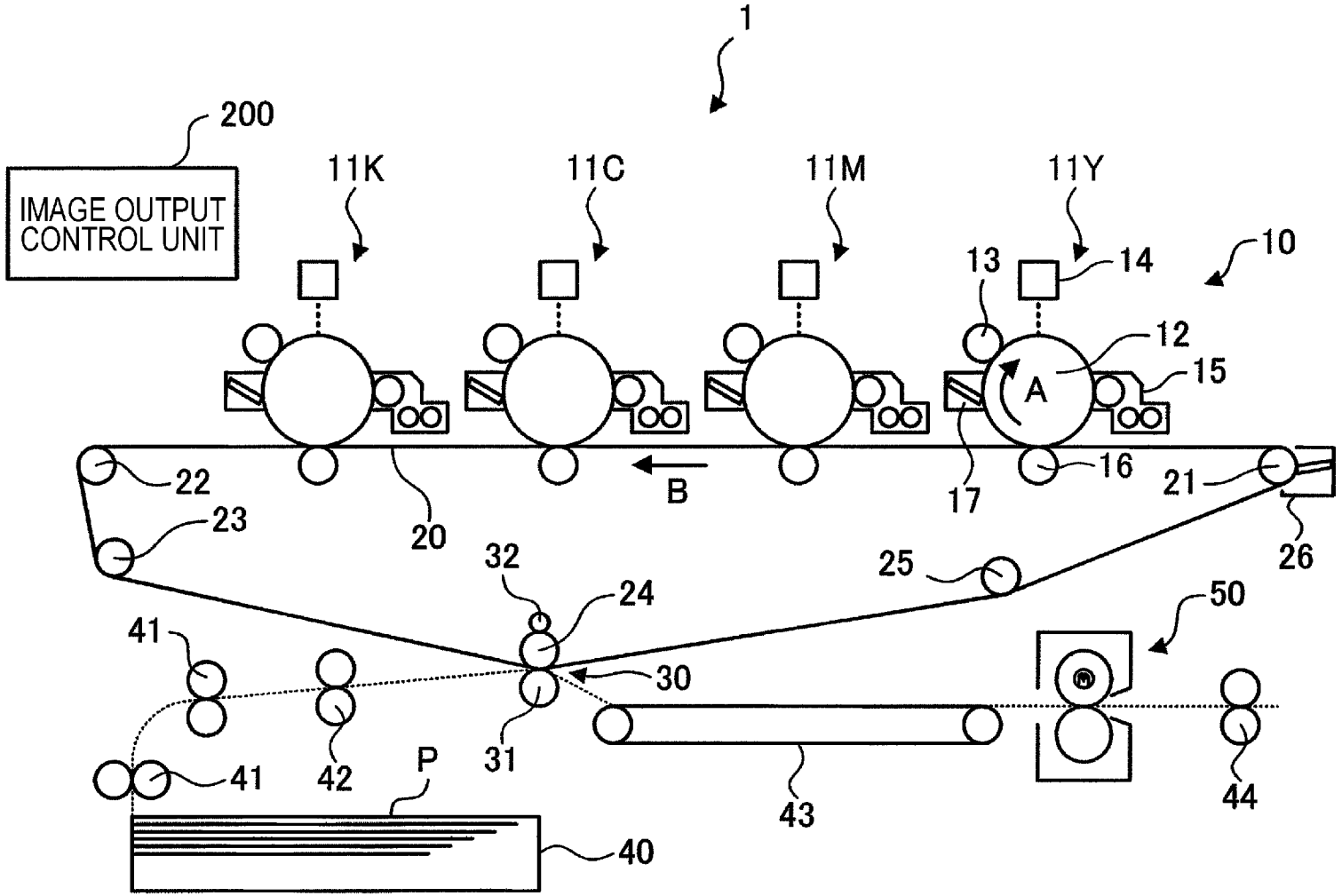
FIG. 1 is a diagram illustrating an overview of an image forming apparatus of the present exemplary embodiment.

FIG. 1 is a diagram illustrating an overview of an image forming apparatus 1 of the present exemplary embodiment.

The image forming apparatus 1 is a generally called tandem-type image forming apparatus. The image forming apparatus 1 includes an image forming section 10 that performs image formation in accordance with image data components of different colors. The image forming apparatus 1 further includes an intermediate transfer belt 20 onto which toner images of different color components that are formed by image forming units 11 are sequentially transferred (in a first transfer process) and held. The image forming apparatus 1 further includes a second transfer device 30 that collectively transfers (in a second transfer process) toner images transferred to the intermediate transfer belt 20 onto one of sheets P, which is an example of a recording medium. The image forming apparatus 1 further includes a fixing device 50 that is an example of a fixing unit and that fixes toner images that have been transferred in the second transfer process to the sheet P onto the sheet P so as to form an image. The image forming apparatus 1 further includes an image-output control unit 200 that controls each mechanism part of the image forming apparatus 1 and performs predetermined image processing on image data.

The image forming section 10 include, for example, the plurality of (four in the present exemplary embodiment) image forming units 11 (specifically, 11Y (yellow), 11M (magenta), 11C (cyan), and 11K (black)) that employ an electrophotographic system and form toner images of the different color components. Each of the image forming units 11 is an example of a toner-image forming unit that forms a toner image.

The image forming units 11 (11Y, 11M, 11C, 11K) have the same configuration except with regard to the colors of toners to be used. Accordingly, the image forming unit 11Y, which corresponds to yellow, will be described below as an example. The image forming unit 11Y corresponding to yellow includes a photoconductor drum 12 that has a photosensitive layer (not illustrated) and that is disposed so as to be rotatable in the direction of arrow A. A charging roller 13, a light-emitting element head 14, a developing unit 15, a first transfer roller 16, and a drum cleaner 17 are arranged around the photoconductor drum 12. The charging roller 13 is disposed so as to be rotatable while being in contact with the photoconductor drum 12 and charges the photoconductor drum 12 to a predetermined potential. The light-emitting element head 14 radiates light onto the photoconductor drum 12 charged to the predetermined potential by the charging roller 13 so as to write an electrostatic latent image onto the photoconductor drum 12. The developing unit 15 contains a toner having the corresponding color component (yellow toner for the image forming unit 11Y) and develops an electrostatic latent image on the photoconductor drum 12 with the toner. The first transfer roller 16 transfers a toner image formed on the photoconductor drum 12 onto the intermediate transfer belt 20 in the first transfer process. The drum cleaner 17 removes residues (such as toner) on the photoconductor drum 12 after the first transfer process.

The photoconductor drum 12 functions as an image carrier that carries an image. The charging roller 13 functions as a charging unit that charges a surface of the photoconductor drum 12. The light-emitting element head 14 functions as an electrostatic-latent-image forming unit (a light emitting device, an exposure device) that forms an electrostatic latent image by exposing the photoconductor drum 12 to light. The developing unit 15 functions as a developing unit that forms a toner image by developing an electrostatic latent image.

The intermediate transfer belt 20 that serves as an image transfer member is rotatably stretched and supported by a plurality of (five in the present exemplary embodiment) support rollers. Among these support rollers, a driving roller 21 stretches the intermediate transfer belt 20 and drives the intermediate transfer belt 20 such that the intermediate transfer belt 20 rotates. Stretching rollers 22 and 25 stretch the intermediate transfer belt 20 and rotate along with the intermediate transfer belt 20 driven by the driving roller 21. A correction roller 23 stretches the intermediate transfer belt 20 and functions as a steering roller that restricts a serpentine movement of the intermediate transfer belt 20 in a direction substantially perpendicular to a transport direction (and that is disposed so as to be freely movable in a tilting manner while an end portion thereof in an axial direction serves as a fulcrum). A backup roller 24 stretches the intermediate transfer belt 20 and functions as a component member of the second transfer device 30, which will be described later.

In addition, a belt cleaner 26 that removes residues (such as toner) on the intermediate transfer belt 20 after the second transfer process is disposed at a position facing the driving roller 21 with the intermediate transfer belt 20 interposed therebetween.

Although it will be described in detail later, in the present exemplary embodiment, the image forming units 11 form images for density correction (reference patches, toner images for density correction) having a predetermined density in order to correct the densities of images. Each of these images for density correction is an example of an image for adjusting the state of the apparatus.

The second transfer device 30 includes a second transfer roller 31 that is disposed so as to be press-contacted against a surface of the intermediate transfer belt 20 on which toner images are to be held and the backup roller 24 that is disposed on the rear surface side of the intermediate transfer belt 20 and serves as an electrode facing the second transfer roller 31. A power supplying roller 32 that applies a second transfer bias having a polarity the same as the charge polarity of the toner to the backup roller 24 is disposed so as to be in contact with the backup roller 24. In contrast, the second transfer roller 31 is grounded.

In the image forming apparatus 1 of the present exemplary embodiment, the intermediate transfer belt 20, the first transfer roller 16, and the second transfer roller 31 form a transfer unit that transfers toner images onto the sheets P.

A sheet transport system includes a sheet tray 40, transport rollers 41, a registration roller 42, a transport belt 43, and an ejection roller 44. In the sheet transport system, one of the sheets P that are stacked in the sheet tray 40 is transported by the transport rollers 41, and then, the transportation of the sheet P is temporarily stopped by the registration roller 42. After that, the sheet P is sent to a second transfer position of the second transfer device 30 at a predetermined timing. After the second transfer process has been performed on the sheet P, the sheet P is transported to the fixing device 50 by the transport belt 43, and the sheet P that is ejected from the fixing device 50 is discharged to the outside of the image forming apparatus 1 by the ejection roller 44.

A basic image forming process of the image forming apparatus 1 will now be described. In response to a start switch (not illustrated) being switched on, a predetermined image forming process is performed. More specifically, in the case where the image forming apparatus 1 is configured as, for example, a printer, the image-output control unit 200 first receives image data input from an external apparatus such as a personal computer (PC). The image-output control unit 200 performs image processing on the received image data and supplies the image data to the image forming units 11. Then, the image forming units 11 form toner images of the different colors. In other words, the image forming units 11 (specifically, 11Y, 11M, 11C, and 11K) are driven in accordance with digital-image signals corresponding to the different colors. Next, in each of the image forming units 11, the light-emitting element head (LPH) 14 radiates light that corresponds to the digital-image signal onto the photoconductor drum 12 charged by the charging roller 13, so that an electrostatic latent image is formed. Then, each of the electrostatic latent images formed on the photoconductor drums 12 is developed by the corresponding developing unit 15, so that toner images of the different colors are formed. Note that, in the case where the image forming apparatus 1 is configured as a copying machine, a scanner may read a document set on a document table (not illustrated), and obtained read signals may be converted into a digital-image signals by a processing circuit. After that, formation of toner images of the different colors may be performed in a manner similar to the above.

Subsequently, the toner images formed on the photoconductor drums 12 are sequentially transferred, in the first transfer process, onto the surface of the intermediate transfer belt 20 by the first transfer rollers 16 at first transfer positions where the photoconductor drums 12 and the intermediate transfer belt 20 are in contact with each other. The toner remaining on each of the photoconductor drums 12 after the first transfer process is removed by the corresponding drum cleaner 17.

The toner images transferred to the intermediate transfer belt 20 in the first transfer process in the manner described above are superposed with one another on the intermediate transfer belt 20 and transported to the second transfer position along with rotation of the intermediate transfer belt 20. In contrast, one of the sheets P is transported to the second transfer position at a predetermined timing and nipped between the backup roller 24 and the second transfer roller 31.

At the second transfer position, a transfer electric field that is generated between the second transfer roller 31 and the backup roller 24 acts on the toner images on the intermediate transfer belt 20 such that the toner images are transferred onto the sheet P in the second transfer process. The sheet P to which the toner images have been transferred is transported to the fixing device 50 by the transport belt 43. In the fixing device 50, the toner images on the sheet P are heated and pressurized so as to be fixed onto the sheet P, and then, the sheet P is sent out to a paper output tray (not illustrated) that is provided outside the image forming apparatus 1. The toner remaining on the intermediate transfer belt 20 after the second transfer process is removed by the belt cleaner 26.

Description of Light-Emitting Element Head 14

Figure 2:
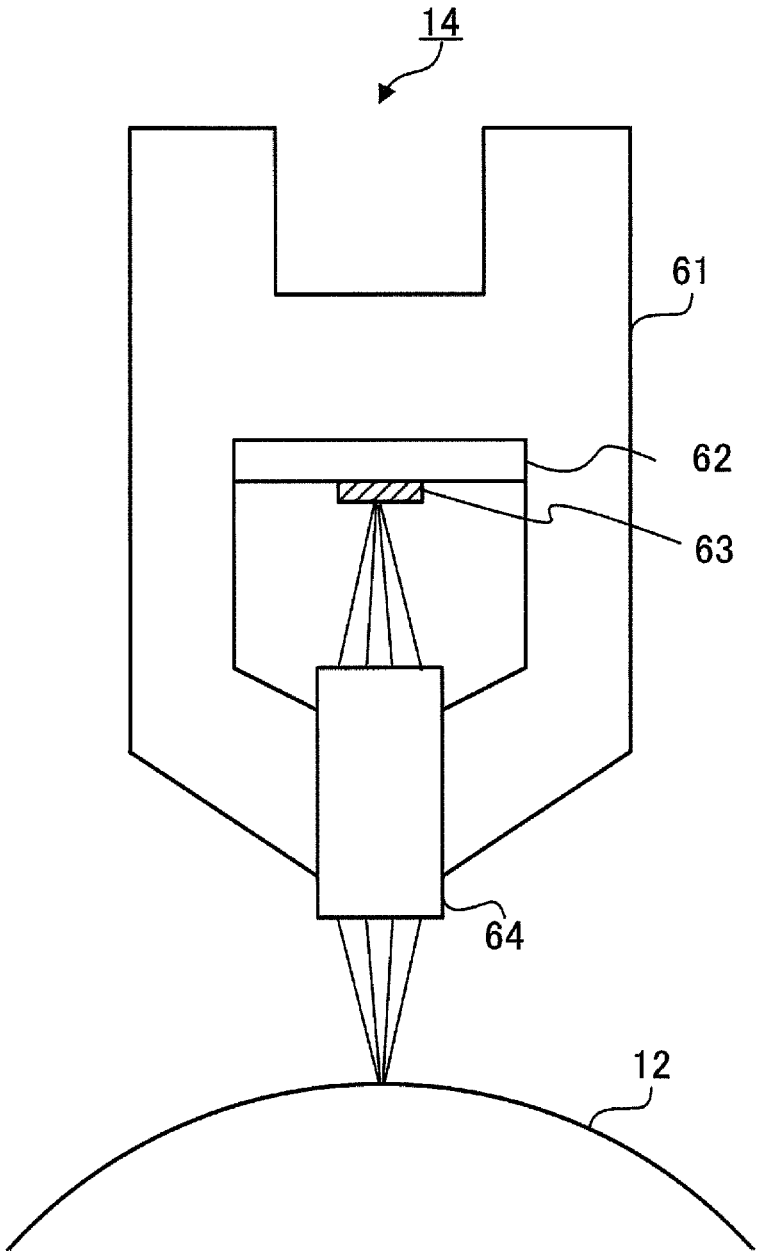
FIG. 2 is a diagram illustrating a configuration of a light-emitting element head to which the present exemplary embodiment is applied.

FIG. 2 is a diagram illustrating the configuration of one of the light-emitting element heads 14 to which the present exemplary embodiment is applied.

The light-emitting element head 14 is an example of a light emitting device and includes a housing 61, a light emitting unit 63 including a plurality of LEDs as light emitting elements, a circuit board 62 on which the light emitting unit 63, a signal generation circuit 100 (see FIG. 3, which will be described later), and so forth are mounted, and a rod lens (radial refractive index distributed lens) array 64 that is an example of an optical element for forming an electrostatic latent image by focusing the light outputs emitted by LEDs and exposing a photoconductor to light.

The housing 61 is made of, for example, a metal and supports the circuit board 62 and the rod lens array 64, and the light emitting point of the light emitting unit 63 and the focal plane of the rod lens array 64 are set to coincide with each other. The rod lens array 64 is disposed along the axial direction of the photoconductor drum 12 (a main scanning direction).

Description of Light Emitting Unit 63

Figure 3A:
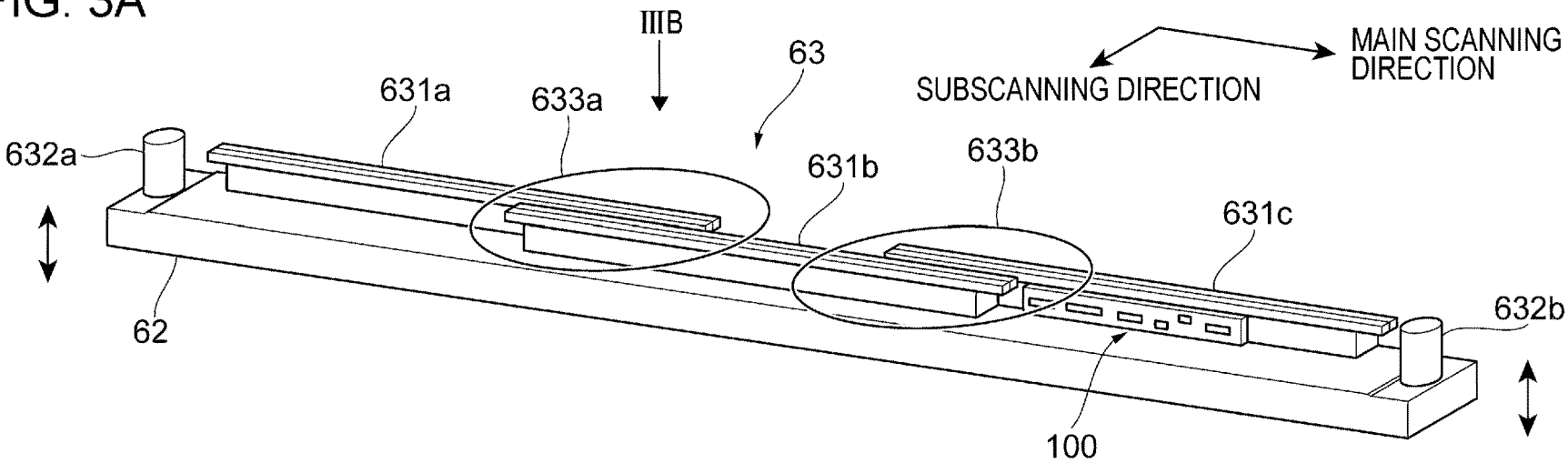
FIG. 3A is a perspective view of a circuit board and a light emitting unit that are included in the light-emitting element head.

FIG. 3A is a perspective view of the circuit board 62 and the light emitting unit 63 included in each of the light-emitting element heads 14.

As illustrated in FIG. 3A, the light emitting unit 63 includes LPH bars 631*a* to 631*c*, focus adjustment pins 632*a* and 632*b*, and the signal generation circuit 100, which is an example of a driving unit used for inputting and outputting signals that drive LEDs.

The LPH bars 631*a* to 631*c* are arranged on the circuit board 62 in a staggered manner in the main scanning direction. The LPH bars 631*a* to 631*c* are arranged in such a manner that each pair of the LPH bars that are adjacent to each other in the main scanning direction partially overlap each other in a subscanning direction, so that joint portions 633*a* and 633*b* are formed. In this case, the joint portion 633*a* is formed by arranging the LPH bar 631*a* and the LPH bar 631*b* such that these LPH bars overlap each other in the subscanning direction, and the joint portion 633*b* is formed by arranging the LPH bar 631*b* and the LPH bar 631*c* such that these LPH bars overlap each other in the subscanning direction.

Note that, when there is no need to distinguish the LPH bars 631*a* to 631*c* from one another, the LPH bars 631*a* to 631*c* will hereinafter sometimes be simply referred to as LPH bars 631. In addition, when there is no need to distinguish the focus adjustment pins 632*a* and 632*b* from each other, the focus adjustment pins 632*a* and 632*b* will hereinafter sometimes be simply referred to as focus adjustment pins 632. Furthermore, when there is no need to distinguish the joint portions 633*a* and 633*b* from each other, the joint portions 633*a* and 633*b* will hereinafter sometimes be simply referred to as joint portions 633.

Figure 3B:
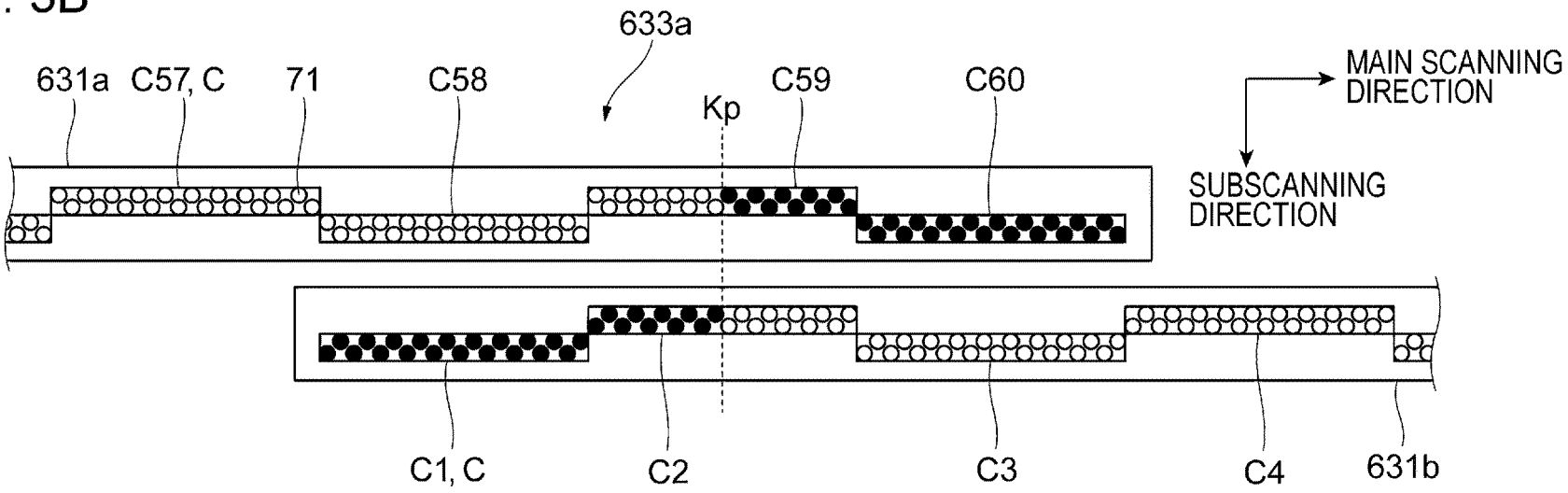
FIG. 3B is a view when the light emitting unit is viewed in a direction of arrow IIIB in FIG. 3A and is an enlarged view of a portion of the light emitting unit.

FIG. 3B is a view when the light emitting unit 63 is viewed in a direction of arrow IIIB in FIG. 3A and is an enlarged view of a portion of the light emitting unit 63. FIG. 3B illustrates the joint portion 633*a* of the LPH bars 631*a* and 631*b*.

As illustrated in FIG. 3B, the LPH bar 631*a* and the LPH bar 631*b* include light emitting chips C each of which is an example of a light-emitting-element array chip. The light emitting chips C are arranged in two staggered rows along the main scanning direction so as to face each other. The number of the light emitting chips C included in each of the LPH bars 631*a* and 631*b* is, for example, 60. Note that, the 60 light emitting chips C will hereinafter sometimes be referred to as light emitting chips C1 to C60. As illustrated in FIG. 3B, each of the light emitting chips C includes LEDs 71. In other words, in this case, a predetermined number of LEDs 71 are included in each of the light emitting chips C, and the LEDs 71 are aligned in the main scanning direction. In addition, the LEDs 71 in each of the light emitting chips C are sequentially turned on in the main scanning direction or a direction opposite to the main scanning direction.

Note that, although not illustrated in FIG. 3B, the LPH bar 631*c* has a configuration similar to that of each of the LPH bars 631*a* and 631*b*. In addition, the joint portion 633*b* has a configuration similar to that of the joint portion 633*a*.

According to the above-described configuration, the plurality of LEDs 71 included in the LPH bar 631*a* and the LPH bar 631*c* may be considered as the LEDs 71 that are arranged in rows in the main scanning direction and that form a first light-emitting-element row. The plurality of LEDs 71 included in the LPH bar 631*b* may be considered as the LEDs 71 that are arranged in rows in the main scanning direction and that form a second light-emitting-element row positioned such that at least a portion of the second light-emitting-element row overlaps the first light-emitting-element row in the subscanning direction.

The joint portions 633*a* and 633*b* may each be considered as an example of an overlapping portion in which the first light-emitting-element row and the second light-emitting-element row overlap each other.

In addition, it may be said that the first light-emitting-element row and the second light-emitting-element row are each formed by arranging the light emitting chips C, in each of which the LEDs 71 are arranged in the main scanning direction.

A switching point Kp is set at a position in each of the joint portions 633*a* and 633*b*, and the light-emitting-element row that is to be caused to emit light is switched between the first light-emitting-element row and the second light-emitting-element row at the switching point Kp. In other words, the LPH bar 631 to be turned on is switched at the switching point Kp. In this case, the LEDs 71 of the LPH bars 631 are turned on in the order of the LEDs 71 of the LPH bar 631*a*, the LEDs 71 of the LPH bar 631*b*, and the LEDs 71 of the LPH bar 631*c*.

In FIG. 3B, the LEDs 71 represented by white circles are turned on, and the LED 71 represented by black circles are not turned on. In other words, in FIG. 3B, the LEDs 71 to be turned on are switched from the LEDs 71 of the LPH bar 631*a* to the LEDs 71 of the LPH bar 631*b* at the switching point Kp. In FIG. 3B, the LEDs 71 of the LPH bar 631*a* are turned on on the left-hand side of the switching point Kp, and the LEDs 71 of the LPH bar 631*b* are turned on on the right-hand side of the switching point Kp.

In the joint portion 633*a* and the joint portion 633*b*, the position of the switching point Kp may be freely set, and the signal generation circuit 100 performs switching control. Accordingly, the signal generation circuit 100 functions as a light-emission control unit that switches the light-emitting-element row to be caused to emit light between the first light-emitting-element row and the second light-emitting-element row at the switching point Kp.

The focus adjustment pins 632*a* and 632*b* enable the circuit board 62 to move in the vertical direction indicated by double-headed arrows in FIG. 3A. In other words, the circuit board 62 is capable of freely moving up and down. By causing the circuit board 62 to move up and down, the distance between the light emitting unit 63 and the photoconductor drum 12 may be changed. As a result, the distance between each of the LPH bars 631*a* to 631*c* and the photoconductor drum 12 is changed, and the focus of the light outputs emitted by the LEDs 71 and focused on the photoconductor drum 12 may be adjusted. Note that the circuit board 62 may be moved in the upward direction by the focus adjustment pins 632*a* and 632*b* on both the side on which the focus adjustment pin 632*a* is disposed and the side on which the focus adjustment pin 632*b* is disposed. The circuit board 62 may also be moved in the downward direction on both the side on which the focus adjustment pin 632*a* is disposed and the side on which the focus adjustment pin 632*b* is disposed. In addition, the circuit board 62 may be moved in the upward direction on one of the side on which the focus adjustment pin 632*a* is disposed and the side on which the focus adjustment pin 632*b* is disposed and may be moved in the downward direction on the other side. The focus adjustment pins 632*a* and 632*b* may operate in response to control by the signal generation circuit 100 or may be manually operated.

Description of Light-Emitting-Element Array Chip

Figure 4A:
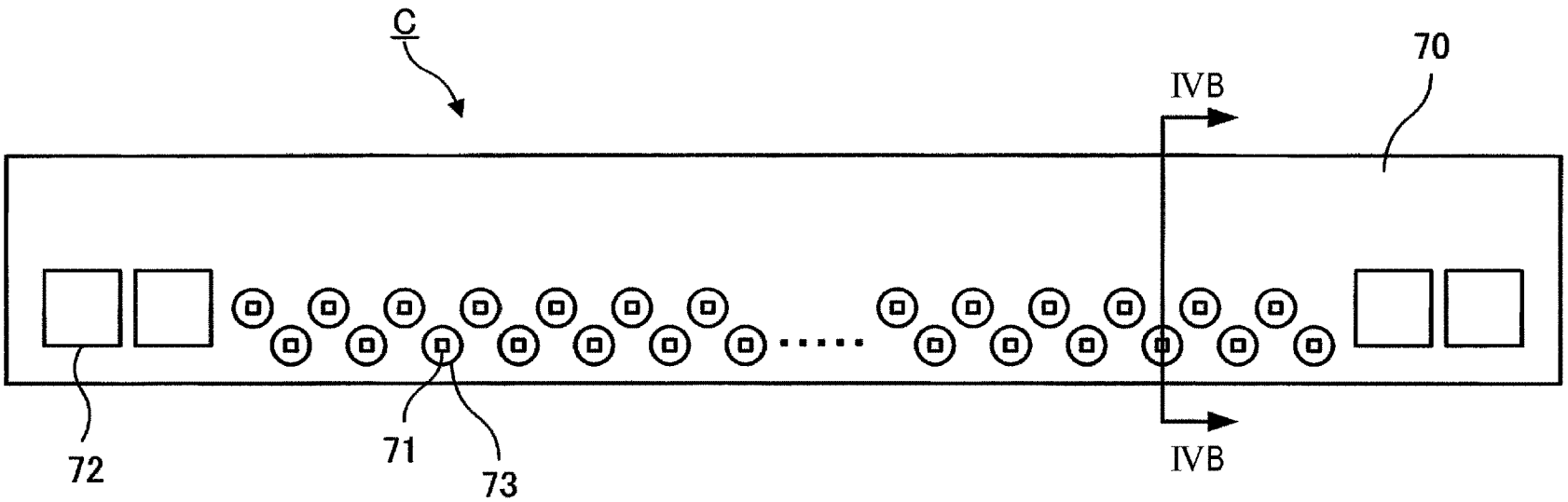
FIGS. 4A and 4B are diagrams each illustrating a structure of one of light emitting chips to which the present exemplary embodiment is applied.
Figure 4B:
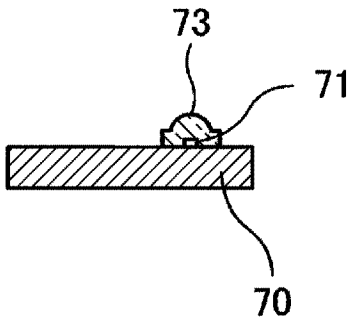

FIGS. 4A and 4B are diagrams each illustrating a structure of each of the light emitting chips C to which the present exemplary embodiment is applied.

FIG. 4A is a view when one of the light emitting chips C is viewed in a direction in which the LEDs 71 emit light. FIG. 4B is a cross-sectional view taken along line IVB-IVB of FIG. 4A.

In the light emitting chip C, the plurality of LEDs 71 arranged in rows in the main scanning direction form a light-emitting-element row as an example of a light-emitting element array. Although it will be described in detail later, each of the light emitting chips C of the present exemplary embodiment has a configuration in which the pitch of the LEDs 71 is changed in a central region of the region in which the LEDs 71 are arranged in rows. In addition, in each of the light emitting chips C, bonding pads 72, each of which is an example of an electrode portion used for inputting and outputting a signal that drives the light-emitting element array, are provided on both sides of a substrate 70 in such a manner that the light-emitting element array is interposed between the bonding pads 72. Each of the LEDs 71 includes a microlens 73 formed on the side on which light is emitted. The light emitted by the LED 71 is converged by the microlens 73, so that the light may be efficiently incident on the photoconductor drum 12 (see FIG. 2).

The microlens 73 is made of a transparent resin such as a photo-curable resin, and a surface of the microlens 73 may have an aspherical shape in order to converge the light more efficiently. The size, the thickness, the focal length, and so forth of the microlens 73 are set depending on the wavelength of the LED 71 that is used, the refractive index of the photo-curable resin that is used, and so forth.

Description of Self-Scanning Light-Emitting-Device Array Chip

Note that, in the present exemplary embodiment, a self-scanning light-emitting-device (SLED) array chip may be used as the light-emitting-element array chip, which is described as an example of each of the light emitting chips C. A self-scanning light-emitting-device array chip is configured to use a light emitting thyristor having a pnpn structure as a component of a light-emitting-element array chip so as to achieve self-scanning of a light emitting element.

Figure 5:
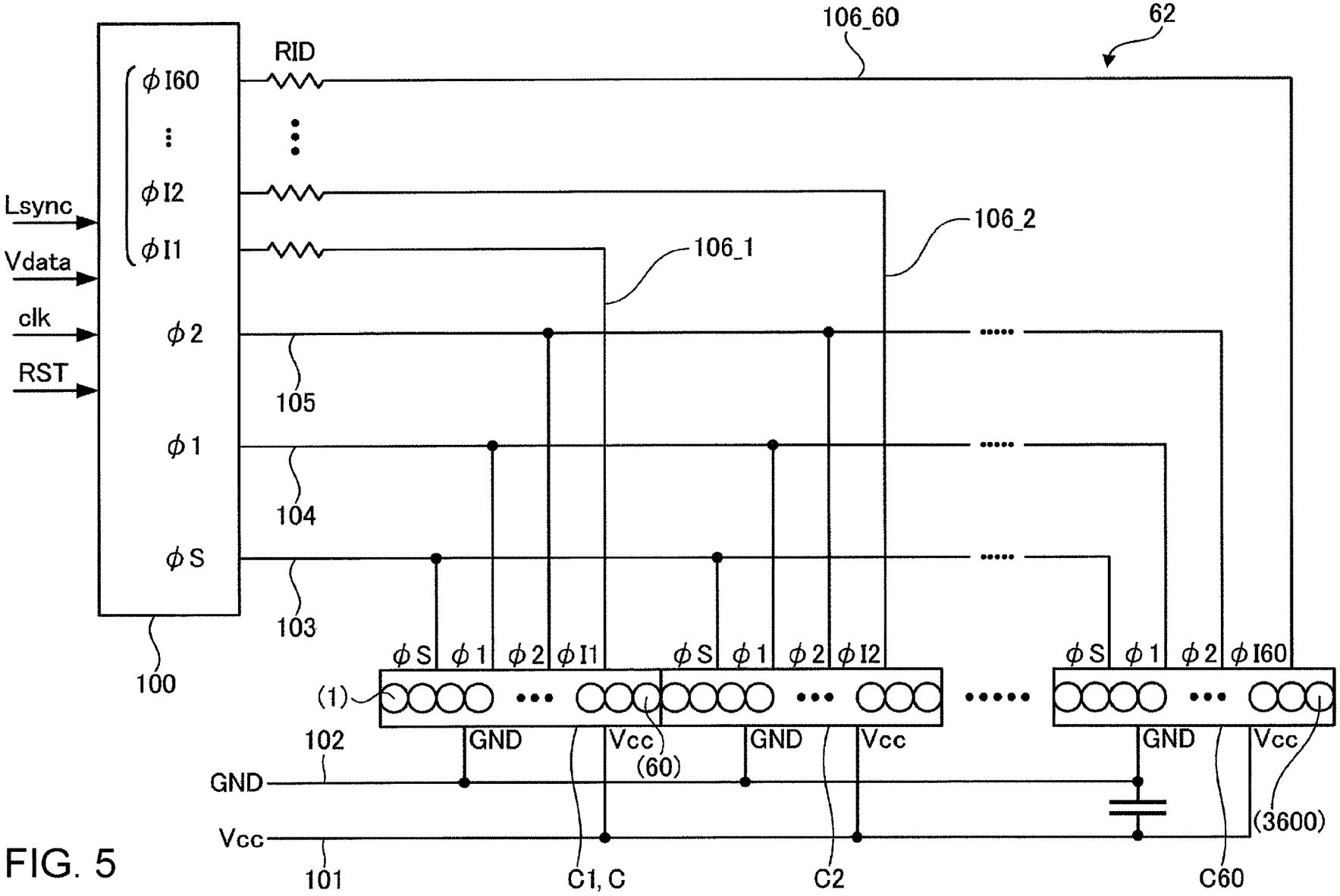
FIG. 5 is a diagram illustrating a configuration of a signal generation circuit and a wiring configuration of the circuit board in the case where a self-scanning light-emitting-device array chip is used as each of the light emitting chips.

FIG. 5 is a diagram illustrating a configuration of the signal generation circuit 100 and a wiring configuration of the circuit board 62 in the case where a self-scanning light-emitting-device array chip is used as each of the light emitting chips C.

Various control signals such as a line synchronization signal Lsync, image data Vdata, a clock signal clk, and a reset signal RST are input to the signal generation circuit 100 from the image-output control unit 200 (see FIG. 1). The signal generation circuit 100 performs, for example, sorting of the image data Vdata, correction of an output value, and so forth on the basis of various control signals input from the outside and outputs light emission signals φI (φI1 to φI60) to the light emitting chips C (C1 to C60). Note that, in the present exemplary embodiment, each of the light emitting chips C (C1 to C60) receives one of the light emission signals φI (φI1 to φI60).

The signal generation circuit 100 outputs a start transfer signal φS, a first transfer signal φ1 and a second transfer signal φ2 to each of the light emitting chips C1 to C60 on the basis of various control signals input from the outside.

A power line 101 for a power supply voltage Vcc of −5.0 V that is connected to a Vcc terminal of each of the light emitting chips C1 to C60 and a power line 102 for grounding that is connected to a GND terminal of each of the light emitting chips C1 to C60 are arranged on the circuit board 62. In addition, a start-transfer-signal line 103, a first-transfer-signal line 104, and a second-transfer-signal line 105 that transmit the start transfer signal φS, the first transfer signal φ1 and the second transfer signal φ2 of the signal generation circuit 100, respectively, are arranged on the circuit board 62. Furthermore, 60 light-emission-signal lines 106 (106_1 to 106_60) that output the light emission signals φI (φI1 to φI60) from the signal generation circuit 100 to the light emitting chips C (C1 to C60) are arranged on the circuit board 62. Note that 60 light-emitting-current limiting resistors RID for preventing an excessive current from flowing through the 60 light-emission-signal lines 106 (106_1 to 106_60) are arranged on the circuit board 62. As will be described later, there are two possible states of each of the light emission signals φI1 to φI60, which are a high level (H) and a low level (L). The electric potential at the low level is −5.0 V, and the electric potential at the high level is ±0.0 V.

Figure 6:
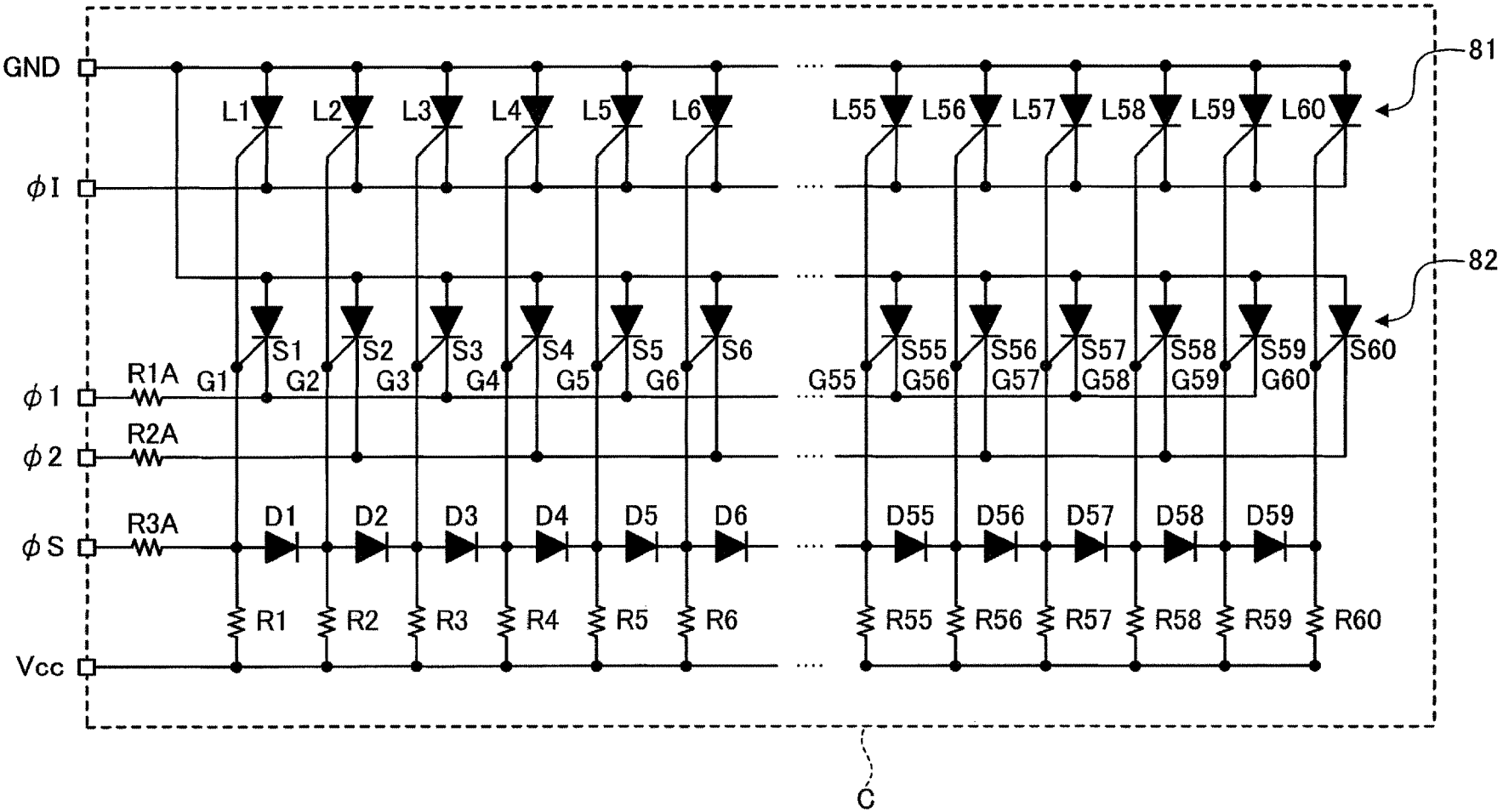
FIG. 6 is a diagram illustrating a circuit configuration of each of the light emitting chips.

FIG. 6 is a diagram illustrating a circuit configuration of each of the light emitting chips C (C1 to C60).

Each of the light emitting chips C includes 60 transfer thyristors S1 to S60 and 60 light emitting thyristors L1 to L60. Note that each of the light emitting thyristors L1 to L60 has a pnpn junction similar to that of each of the transfer thyristors S1 to S60 and is configured to also function as a light emitting diode (LED) by using a pn junction, which is part of the pnpn junction. In addition, each of the light emitting chips C includes 59 diodes D1 to D59 and 60 resistors R1 to R60. Furthermore, each of the light emitting chips C includes transfer-current limiting resistors R1A, R2A, and R3A for preventing an excessive current from flowing through signal lines to which the first transfer signal φ1, the second transfer signal φ2, and the start transfer signal φS are supplied. Note that the light emitting thyristors L1 to L60 that are included in a light-emitting element array 81 are arranged in the order of L1, L2, . . . , L59, L60 from the left-hand side in FIG. 6 so as to form a light-emitting-element row. Similarly, the transfer thyristors S1 to S60 are arranged in the order of S1, S2, . . . , S59, S60 from the left-hand side in FIG. 6 so as to form a switching element row, that is, a switching element array 82. In addition, the diodes D1 to D59 are arranged in the order of D1, D2, . . . , D58, D59 from the left-hand side in FIG. 6. Furthermore, the resistors R1 to R60 are arranged in the order of R1, R2, . . . , R59, R60 from the left-hand side in FIG. 6.

Electrical connection of each element in one of the light emitting chips C will now be described.

The anode terminal of each of the transfer thyristors S1 to S60 is connected to the GND terminal. The power line 102 (see FIG. 5) is connected to the GND terminal and grounded.

The cathode terminals of the odd-numbered transfer thyristors S1, S3, . . . , S59 are connected to a φ1 terminal via the transfer-current limiting resistor R1A. The first-transfer-signal line 104 (see FIG. 5) is connected to the φ1 terminal, and the first transfer signal φ1 is supplied to the φ1 terminal.

In contrast, the cathode terminals of the even-numbered transfer thyristors S2, S4, . . . , S60 are connected to a φ2 terminal via the transfer-current limiting resistor R2A. The second-transfer-signal line 105 (see FIG. 5) is connected to the φ2 terminal, and the second transfer signal φ2 is supplied to the φ2 terminal.

The gate terminals G1 to G60 of the transfer thyristors S1 to S60 are connected to the Vcc terminal via the resistors R1 to R60 that are arranged so as to correspond to the transfer thyristors S1 to S60, respectively. The power line 101 (see FIG. 5) is connected to the Vcc terminal, and the power supply voltage Vcc (−5.0 V) is supplied to the Vcc terminal.

In addition, the gate terminals G1 to G60 of the transfer thyristors S1 to S60 are connected in one-to-one to the gate terminals of the light emitting thyristors L1 to L60 in such a manner that the gate terminal of the transfer thyristor and the gate terminal of the light emitting thyristor that are denoted by the same number are connected to each other.

The anode terminals of the diodes D1 to D59 are connected to the gate terminals G1 to G59 of the transfer thyristors S1 to S59, and the cathode terminals of the diodes D1 to D59 are connected to the gate terminals G2 to G60 of the adjacent transfer thyristors S2 to S60 at the following stage. In other words, the diodes D1 to D59 are connected in series with the gate terminals G1 to G60 of the transfer thyristors S1 to S60 interposed therebetween.

The anode terminal of the diode D1, that is, the gate terminal G1 of the transfer thyristor S1 is connected to a φS terminal via the transfer-current limiting resistor R3A. The start transfer signal φS is supplied to the φS terminal through the start-transfer-signal line 103 (see FIG. 5).

Similar to the anode terminals of the transfer thyristors S1 to S60, the anode terminals of the light emitting thyristors L1 to L60 are connected to the GND terminal.

The cathode terminals of the light emitting thyristors L1 to L60 are connected to a φI terminal. The light-emission-signal line 106 (the light-emission-signal line 106_1 for the light emitting chip C1: see FIG. 5) is connected to the φI terminal, and the light emission signal φI (the light emission signal φI1 for the light emitting chip C1) is supplied to the φI terminal. Note that each of the light emission signals φI2 to φI60 is supplied to a corresponding one of the other light emitting chips C2 to C60.

Description of Black Streak and White Streak Generated at Switching Point Kp

In the present exemplary embodiment, as described above, the LPH bar 631 whose LEDs 71 are to be turned on is switched in the order of the LPH bar 631*a*, the LPH bar 631*b*, and the LPH bar 631*c*. In this case, however, as a result of the pitch of the LEDs 71 being changed at the switching point Kp, a black streak or a white streak may sometimes be generated in an image that is formed on one of the sheets P.

Figure 7A:
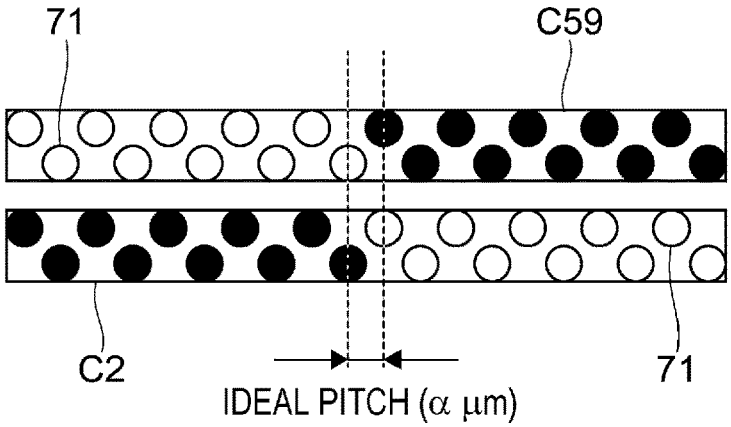
FIGS. 7A to 7C are diagrams each illustrating a case where a black streak or a white streak is generated in an image formed on a sheet as a result of the pitch of LEDs being changed at a switching point.
Figure 7B:
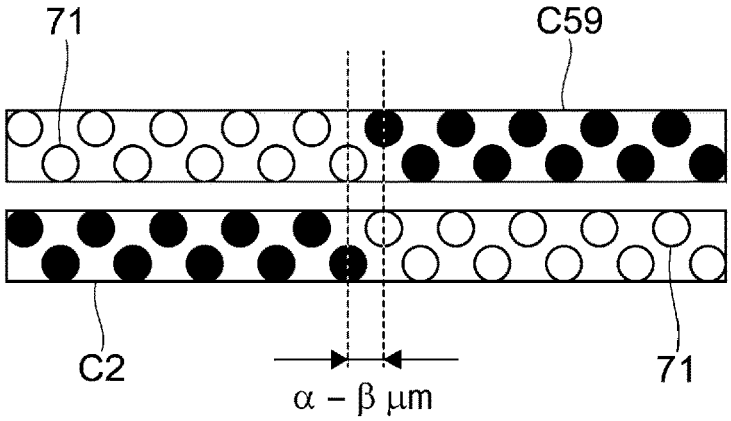
Figure 7C:
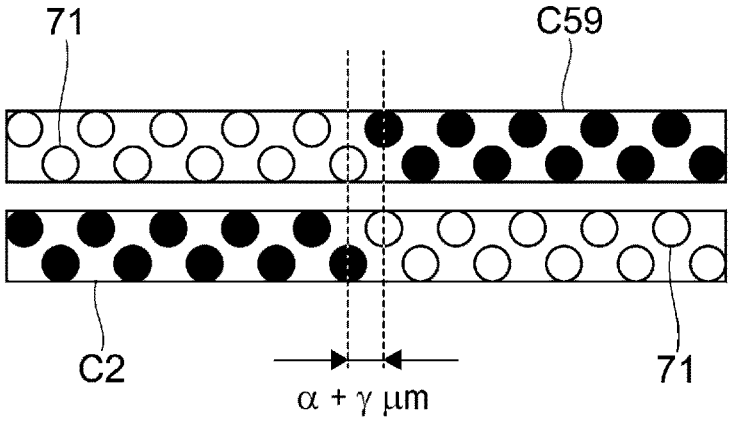

FIGS. 7A to 7C are diagrams each illustrating a case where a black streak or a white streak is generated in an image formed on one of the sheets P as a result of the pitch of the LEDs 71 being changed at the switching point Kp.

FIG. 7A illustrates the case where the LEDs 71 of the LPH bar 631*a* and the LEDs 71 of the LPH bar 631*b* are aligned in the subscanning direction at the switching point Kp, and as a result, the pitch of LEDs 71 in the LPH bar 631*a* and the pitch of LEDs 71 in the LPH bar 631*b* are each αμm, which is an ideal pitch, at the switching point Kp. In other words, the pitch of adjacent ones of the LEDs 71 of the LPH bar 631*a* and the pitch of adjacent ones of the LEDs 71 of the LPH bar 631*b* are each αμm, and also the pitch of the LEDs 71 of the LPH bar 631*a* and the pitch of the LEDs 71 of the LPH bar 631*b* at the switching point Kp are each αμm, which is the ideal pitch. That is to say, FIG. 7A illustrates the case where the ideal pitch, which is αμm, is maintained also at the switching point Kp. In this case, even when switching is performed from the LEDs 71 of the LPH bar 631*a* to the LEDs 71 of the LPH bar 631*b* at the switching point Kp, a black streak or a white streak will not be generated in an image that is formed on the sheet P.

In contrast, FIG. 7B and FIG. 7C each illustrate the case where the LEDs 71 of the LPH bar 631*a* and the LEDs 71 of the LPH bar 631*b* are not aligned in the subscanning direction at the switching point Kp and where misalignment occurs in the main scanning direction.

FIG. 7B illustrates the case where the pitch of the LEDs 71 of the LPH bar 631*a* and the pitch of the LEDs 71 of the LPH bar 631*b* at the switching point Kp are each α−βμm that is smaller than αμm, which is the ideal pitch. In this case, when switching is performed from the pitch of the LEDs 71 of the LPH bar 631*a* to the pitch of the LEDs 71 of the LPH bar 631*b* at the switching point Kp, the density of an image to be formed becomes high at the switching point Kp. As a result, a black streak extending in the subscanning direction is generated in the image formed on the sheet P.

In contrast, FIG. 7C illustrates the case where the pitch of the LEDs 71 of the LPH bar 631*a* and the pitch of the LEDs 71 of the LPH bar 631*b* at the switching point Kp are each α+γμm that is larger than αμm, which is the ideal pitch. In this case, when switching is performed from the pitch of the LEDs 71 of the LPH bar 631*a* to the pitch of the LEDs 71 of the LPH bar 631*b* at the switching point Kp, the density of an image to be formed becomes low at the switching point Kp. As a result, a white streak extending in the subscanning direction is generated in the image formed on the sheet P.

Each of the phenomena illustrated in FIGS. 7B and 7C occurs due to misalignment between the LPH bar 631*a* and the LPH bar 631*b* in the main scanning direction. In other words, in the case illustrated in FIG. 7B, the LPH bar 631*a* and the LPH bar 631*b* are displaced from each other by −βμm in the main scanning direction. In the case illustrated in FIG. 7C, the LPH bar 631*a* and the LPH bar 631*b* are displaced from each other by +γμm in the main scanning direction. However, it is difficult to perform positioning of the LPH bars 631 in the main scanning direction on the order of micrometers.

Description of Method for Suppressing Black Streak and White Streak

Accordingly, in the present exemplary embodiment, the occurrence of the above-described problem is suppressed by using the light emitting chips C, which will be described below.

Figure 8:
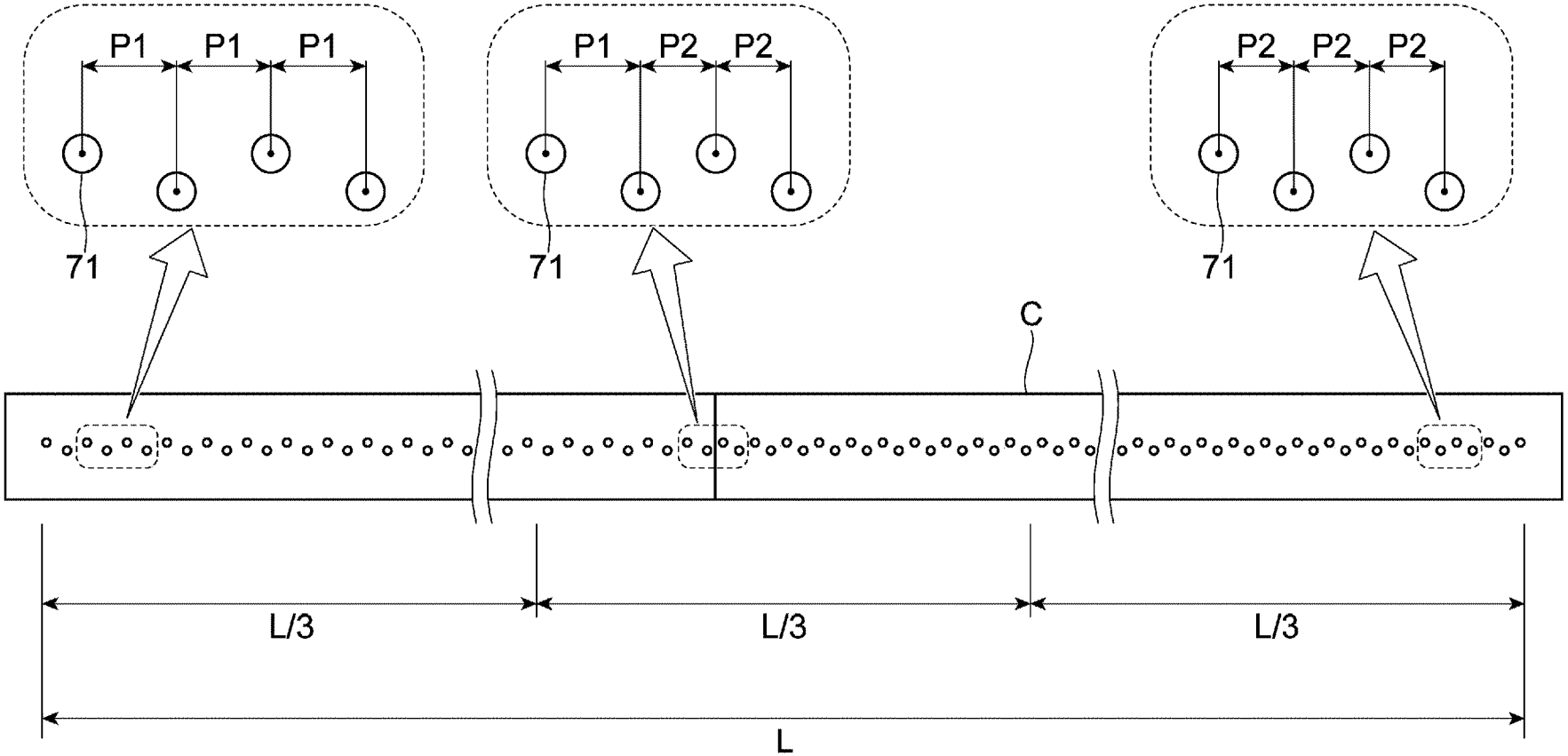
FIG. 8 is a diagram illustrating an alignment of the LEDs included in each of the light emitting chips.

FIG. 8 is a diagram illustrating an alignment of the LEDs 71 included in each of the light emitting chips C.

In the light emitting chip C illustrated in FIG. 8, the pitch of the LEDs 71 is changed from a pitch P1 to a pitch P2, which is different form the pitch P1, in the central region of the region in which the LEDs 71 are arranged in rows. Note that, here, a relationship of P1>P2 is satisfied. In other words, in the main scanning direction, the pitch is switched from the pitch P1, which is wide, to the pitch P2, which is narrow, in the central region. Here, when the length of the region in which the LEDs 71 are arranged in rows in the main scanning direction is L, and this region is divided into three L/3 areas, the term "central region" refers to a region located in the L/3 area at the center. Note that, when the length of the region in which the LEDs 71 are arranged in rows in the main scanning direction is L, and this region is divided into five L/5 areas, the central region may be located in the L/5 area at the center.

Here, the pitch P1 is an example of a first pitch, and the pitch P2 is an example of a second pitch. In addition, although the relationship of P1>P2 is satisfied in the present exemplary embodiment, the pitch P1 and the pitch P2 may be set such that a relationship of P1<P2 is satisfied.

Figure 9A:
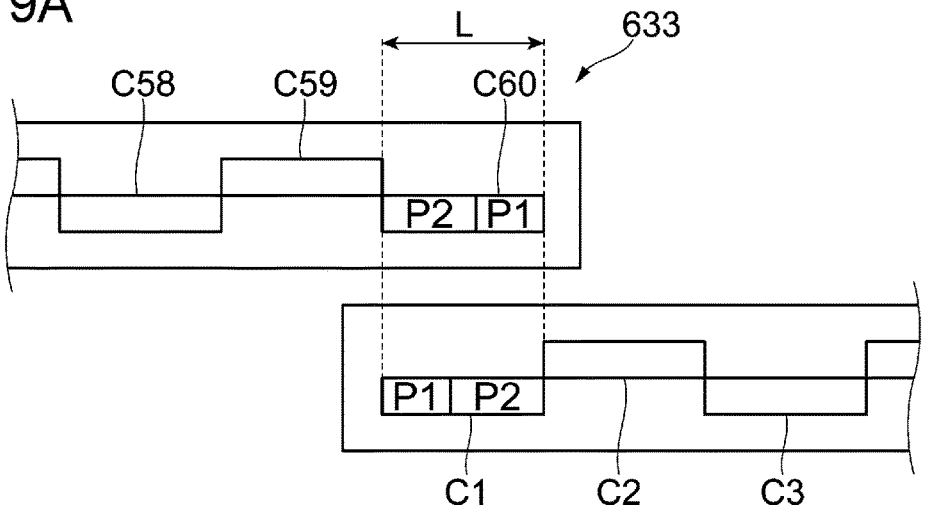
FIG. 9A is a diagram illustrating an arrangement example of the light emitting chips in a joint portion.

FIG. 9A is a diagram illustrating an arrangement example of the light emitting chips C in one of the joint portions 633.

In the present exemplary embodiment, the light emitting chips C each having the configuration illustrated in FIG. 8 face each other in the joint portion 633 such that one of the light emitting chips C is reversed in the main scanning direction. As a result, in at least a portion of the joint portion 633, the LEDs 71 arranged at the pitch P1 and the LEDs 71 arranged at the pitch P2 face each other.

FIG. 9A illustrates the case where the light emitting chips C each having the configuration illustrated in FIG. 8 face each other in the joint portion 633 such that one of the light emitting chips C is reversed in the main scanning direction. In this case, the light emitting chip C60 and the light emitting chip C1 face each other.

In the main scanning direction, the width of the region in which these light emitting chips C face each other such that one of the light emitting chips C is reversed in the main scanning direction may be half or more of the width of the region in which the LEDs 71 included in the light emitting chips C are aligned. In other words, in FIG. 9A, the width of the region in which the light emitting chips C are arranged one above the other in such a manner as to overlap each other in the main scanning direction may be half or more of the width of the region in which the LEDs 71 are aligned. As a result, the number of the LEDs 71 arranged at the pitch P1 and the number of the LEDs 71 arranged at the pitch P2 may be increased, and although it will be described in detail later, the resolution when determining the switching point Kp may be increased.

Figure 9B:
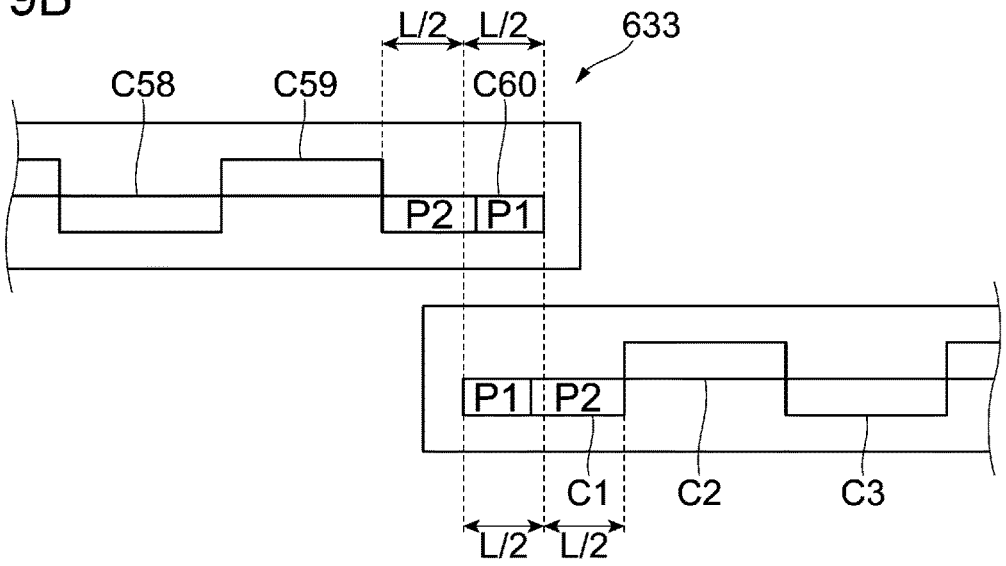
FIGS. 9B and 9C are diagrams each illustrating a width of a region in which the light emitting chips overlap each other in a main scanning direction.
Figure 9C:
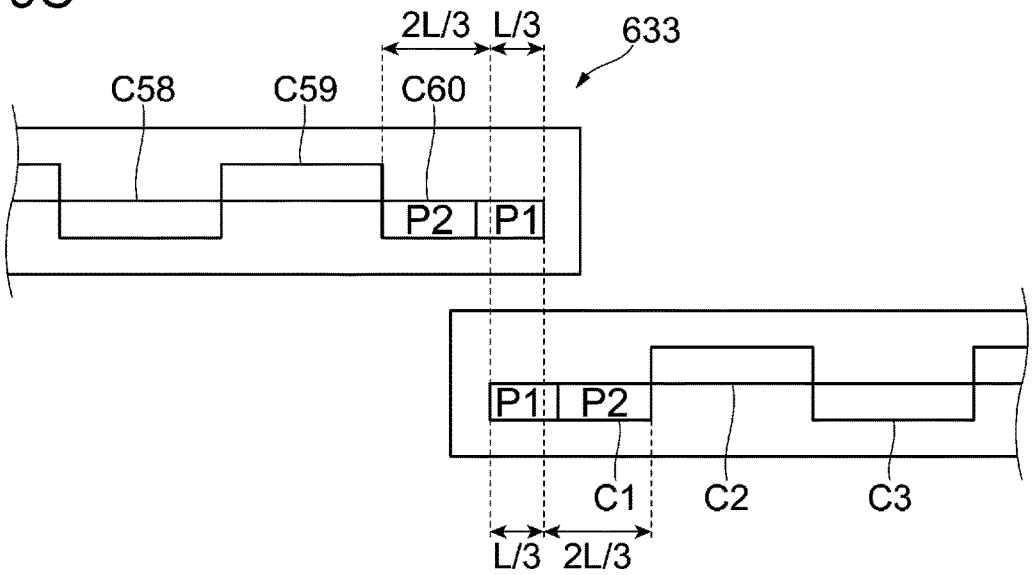

FIGS. 9B and 9C are diagrams each illustrating a width of the region in which the light emitting chips C overlap each other in the main scanning direction.

FIG. 9A illustrates the case in which the width of the region in which the light emitting chips C overlap each other in the main scanning direction is equal to the width L of the region in which the LEDs 71 are aligned. FIG. 9B illustrates that the width of the region in which the light emitting chips C overlap each other in the main scanning direction is L/2, which is half of the width L of the region in which the LEDs 71 are aligned. FIG. 9C illustrates the case in which the width of the region in which the light emitting chips C overlap each other in the main scanning direction is L/3, which is one-third of the width L of the region in which the LEDs 71 are aligned. Accordingly, the case illustrated in FIG. 9A and the case illustrated in FIG. 9B meet the above-mentioned condition, and the case illustrated in FIG. 9C does not meet the above-mentioned condition. Note that the width of the region in which the light emitting chips C overlap each other may be equal to or greater than 75% of the width L of the region in which the LEDs 71 are aligned, and is preferably equal to or greater than 90% of the width L.

Then, the light-emitting-element row that is to be caused to emit light is switched between the first light-emitting-element row and the second light-emitting-element row at any point in the joint portions 633 at which the LEDs 71 forming the first light-emitting-element row and the LEDs 71 forming the second light-emitting-element row are aligned in the subscanning direction.

Figure 10:
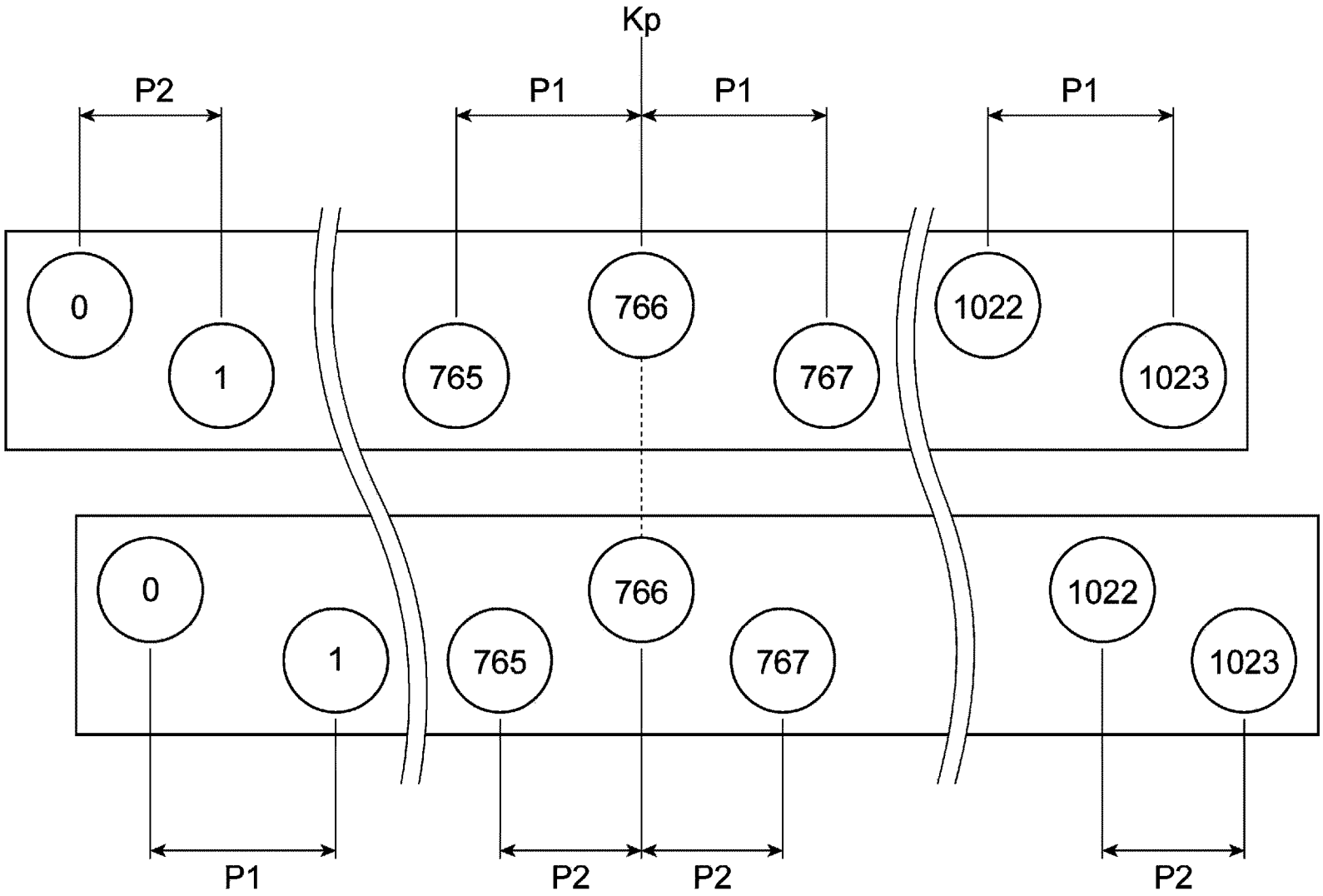
FIG. 10 is an enlarged view of the peripheral portion of the switching point illustrated in FIG. 9A.

FIG. 10 is an enlarged view of the peripheral portion of the switching point Kp illustrated in FIG. 9A.

In this case, the light emitting chip C60 located on the upper side in FIG. 10 and the light emitting chip C1 located on the lower side in FIG. 10 each include the 1,024 LEDs 71 that are denoted by the numbers 0 to 1023. In this case, the LEDs 71 of the light emitting chip C60 form the first light-emitting-element row. The LEDs 71 of the light emitting chip C1 form the second light-emitting-element row. FIG. 10 illustrates the case where the LEDs 71 each of which is denoted by the number 766 are aligned in the subscanning direction. In FIG. 10, since the pitch P1 of the LEDs 71 of the light emitting chip C60 and the pitch P2 of the LEDs 71 of the light emitting chip C1, which form the second light-emitting-element row, are different from each other, the LEDs 71 that are disposed in front of the LEDs 71 denoted by the number 766 are not aligned with each other in the subscanning direction, and the LEDs 71 that are disposed behind the LEDs 71 denoted by the number 766 are not aligned with each other in the subscanning direction. Note that, although FIG. 10 illustrates the case where the LEDs 71 denoted by the same number are aligned in the subscanning direction, the LEDs 71 denoted by different numbers may be aligned in the subscanning direction.

According to the above-described method, the switching point Kp is a point at which at least one of the LEDs 71 of the light emitting chip C60 and at least one of the LEDs 71 of the light emitting chip C1 are aligned by chance in the subscanning direction. In each of the light emitting chips C of the present exemplary embodiment, the width of the region in which the LEDs 71 are aligned in the main scanning direction is, for example, 10.8 mm. When the resolution is set to 2,400 dots per inch (dpi), the 1,024 LEDs 71 are aligned in the region having this width. In this case, the pitch P1 is, for example, 25,400 μm/2,400≈10.6 μm. The difference between the pitch P1 and the pitch P2 may be, for example, 0.01 μm. In this case, for example, the switching point Kp may be determined with a resolution of 0.1 μm to 0.2 μm. This determination is enabled by causing the large number of LEDs 71 aligned at the pitch P1 and the large number of LEDs 71 aligned at the pitch P2 to face each other.

In contrast, in the case of the light emitting chip C in which the pitch of the LEDs 71 is changed only at an end portion thereof, the number of the LEDs 71 that are located at the end portion is small, and the number of the LEDs 71 aligned at the pitch P1 and the number of the LEDs 71 aligned at the pitch P2 are both small. In this case, the difference between the pitch P1 and the pitch P2 inevitably becomes large. Thus, the resolution when performing alignment is low, and it is unlikely that the LEDs 71 are aligned in the subscanning direction. As a result, a black streak or a white streak is likely to be generated.

In addition, for example, with a pitch difference of about 0.01 μm, it would be fair to say that degradation of image quality rarely occurs in an image that is formed on one of the sheets P. In contrast, in the case of the light emitting chip C in which the pitch of the LEDs 71 is changed only at an end portion thereof, the pitch difference becomes large, and degradation of image quality is likely to occur.

Note that, in the above case, although correction of the density difference in one of the joint portions 633 between the LPH bars 631 has been described, the present disclosure may be applied to suppression of a black streak or a white streak that is generated between the light emitting chips C due to misalignment of the light emitting chips C.

Description of Turn-On Direction of LEDs 71

Figure 11A:
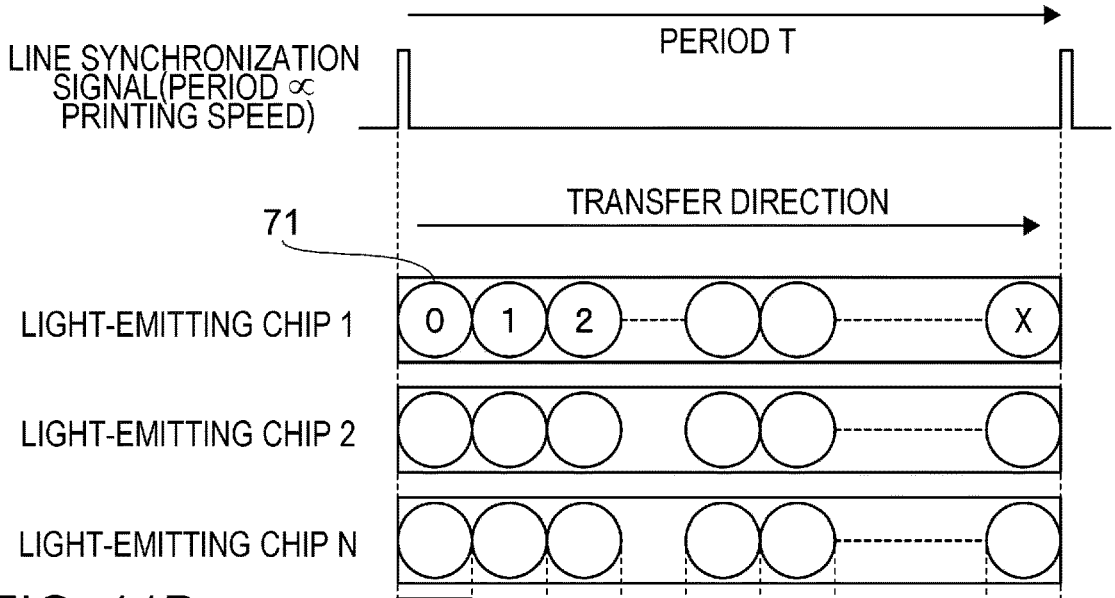
FIGS. 11A and 11B are diagrams each illustrating a state in which the light emitting chips are turned on, and FIG. 11C is a diagram illustrating that transfer directions of the adjacent light emitting chips C are opposite to each other.
Figure 11B:
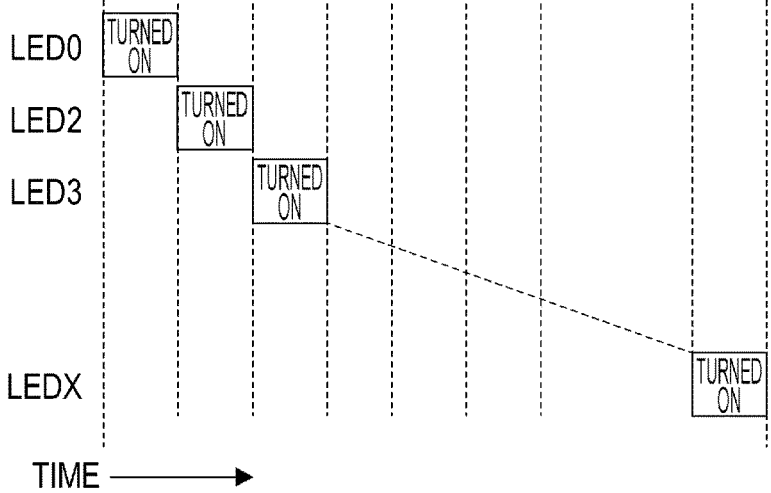

FIGS. 11A and 11B are diagrams each illustrating a state in which the light emitting chips C are turned on.

As illustrated in FIG. 11A, the LEDs 71 of each of the light emitting chips C are sequentially turned on in a transfer direction. In other words, the LEDs 71 of each of the light emitting chips C are sequentially turned on from a transfer start direction toward a transfer end direction by a time-division driving method. FIG. 11A illustrates that the LEDs 71 that are denoted by the numbers 0 to x are sequentially turned on as the LEDs 71 included in each of the light emitting chips C. In this case, on a time axis illustrated in FIG. 11A, the LEDs 71 of the light emitting chips C do not emit light at the same time.

In addition, since the photoconductor drums 12 rotate, the LED 71 to be turned on is shifted among the LEDs 71 in the subscanning direction over time as illustrated in FIG. 11B, and an electrostatic latent image is formed on each of the photoconductor drums 12. As a result, an image also becomes misaligned in the subscanning direction and is formed onto one of the sheets P.

Figure 11C:
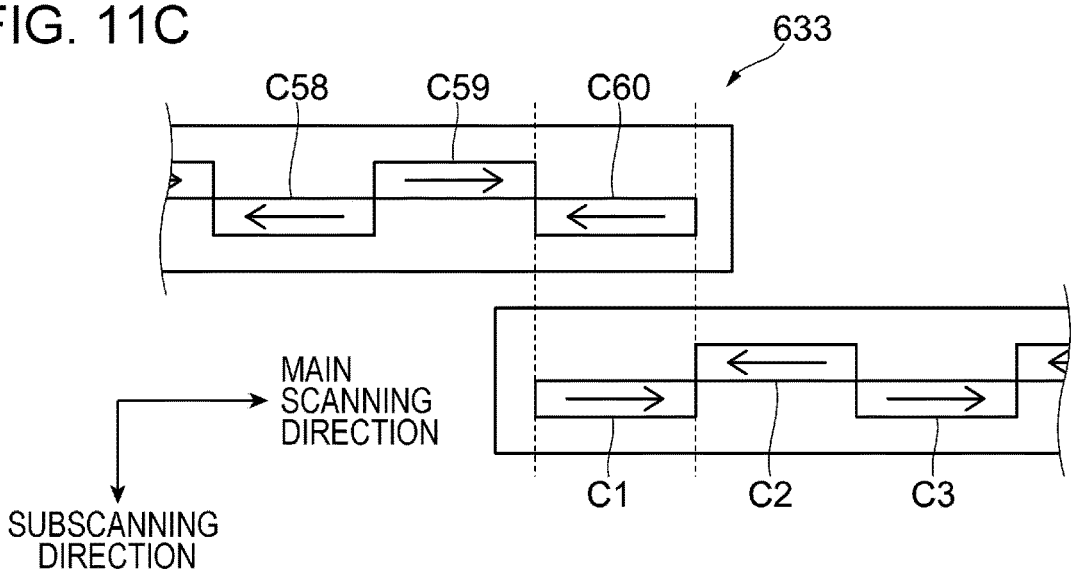

The transfer direction is set for each of the light emitting chips C such that the transfer directions of the adjacent light emitting chips C are opposite to each other. In FIG. 11C, the transfer direction is indicated by an arrow illustrated in each of the light emitting chips C.

In this case, in the related art, the transfer directions set for the light emitting chips C that are positioned in the joint portion 633 are opposite to each other.

Figure 12A:
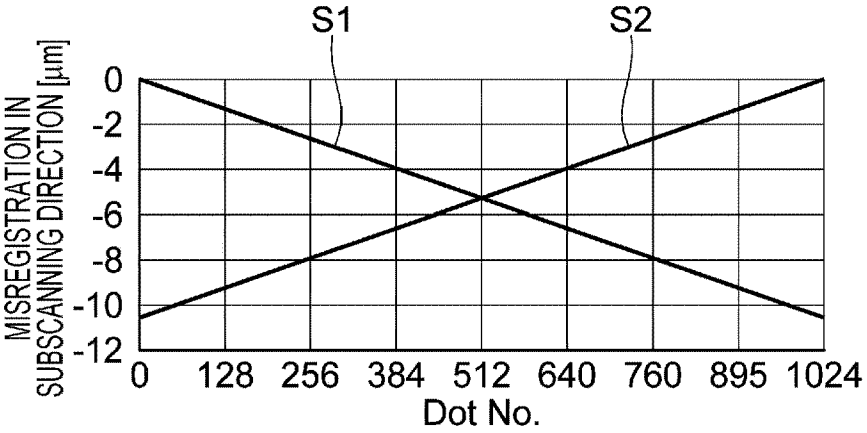
FIG. 12A is a graph comparing the state in which an image is formed onto a sheet in such a manner as to be misaligned in a subscanning direction when a transfer direction is the same as the main scanning direction and the state in which an image is formed onto a sheet in such a manner as to be misaligned in the subscanning direction when the transfer direction is the same as a direction opposite to the main scanning direction.

FIG. 12A is a graph comparing the state in which an image is formed onto one of the sheets P in such a manner as to be misaligned in the subscanning direction when the transfer direction is the same as the main scanning direction and the state in which an image is formed onto one of the sheets P in such a manner as to be misaligned in the subscanning direction when the transfer direction is the same as a direction opposite to the main scanning direction. Here, the horizontal axis denotes positions in the main scanning direction, and the positions are indicated by the numbers given to the LEDs. The direction toward the right-hand side in FIG. 12A corresponds to the main scanning direction. The vertical axis denotes displacement amount in the subscanning direction, and the downward direction in FIG. 12A corresponds to the subscanning direction.

A straight line S1 indicates the case in which the transfer direction is the same as the main scanning direction. The straight line S1 indicates that the displacement amount of the image in the subscanning direction increases in the main scanning direction.

A straight line S2 indicates the case in which the transfer direction is the same as the direction opposite to the main scanning direction. The straight line S2 indicates that the displacement amount of the image in the subscanning direction increases in the direction opposite to the main scanning direction.

Figure 12B:
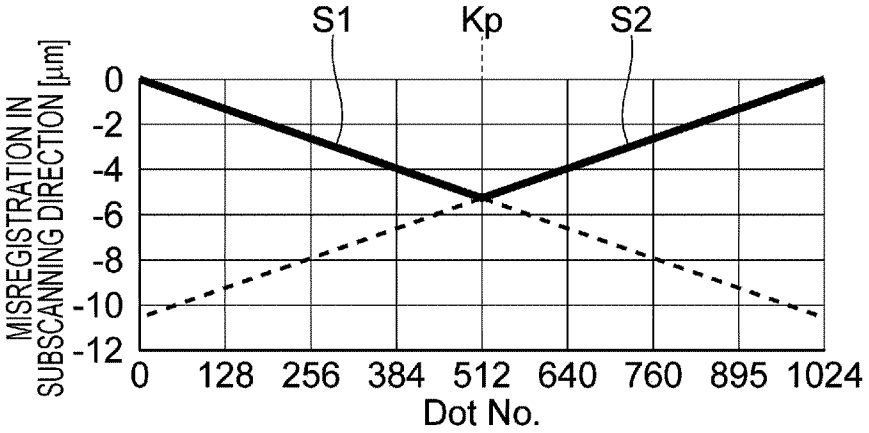
FIGS. 12B to 12D are graphs each illustrating an image that is formed when a switching point is changed.
Figure 12C:
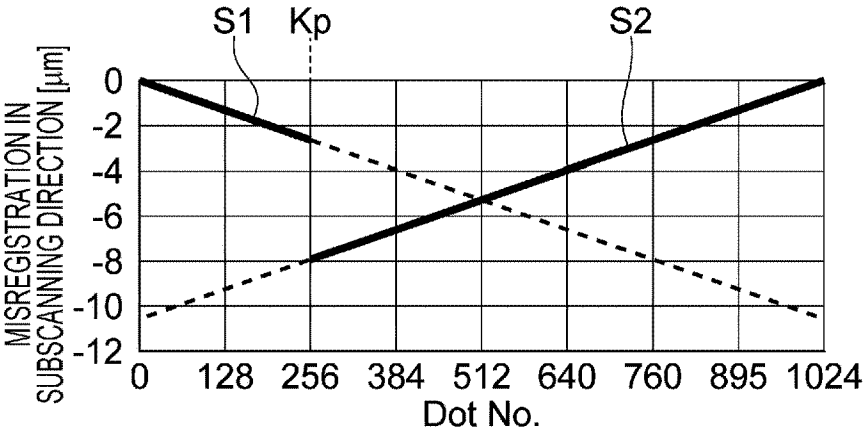
Figure 12D:
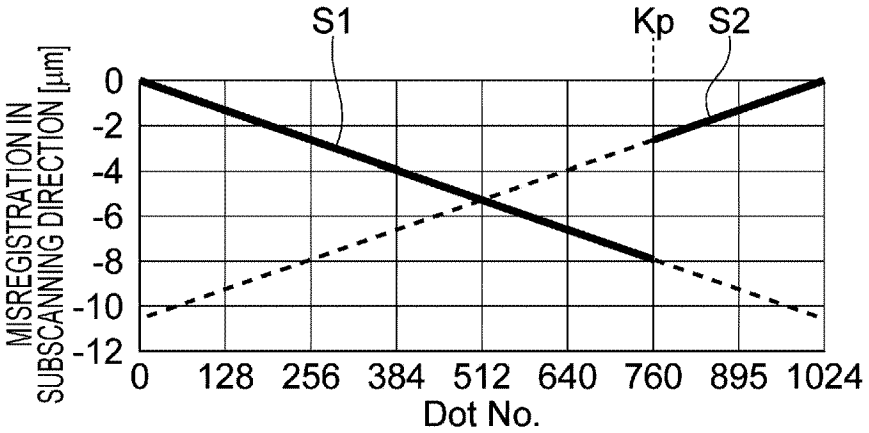

FIGS. 12B to 12D are graphs each illustrating an image that is formed when the switching point Kp is changed.

When the LEDs 71 to be turned on are switched at the switching point Kp, the state of the image formed onto the sheet P shifts from the straight line S1 to the straight line S2.

FIG. 12B illustrates an image that is formed on the sheet P in the case where the switching point Kp is set at the center of the region in which the LEDs 71 are arranged in rows in the main scanning direction. In this case, the switching point Kp is located at the intersection of the straight line S1 and the straight line S2, and thus, portions of the image to be formed are connected to each other at the switching point Kp and contiguous with each other as indicated by the bold line.

In contrast, FIG. 12C illustrates an image that is formed on the sheet P in the case where the switching point Kp is set at a position in front of the center of the region in which the LEDs 71 are arranged in rows in the main scanning direction. In this case, the switching point Kp is positioned in front of the intersection of the straight line S1 and the straight line S2, and thus, portions of the image to be formed are not connected to each other at the switching point Kp and noncontiguous with each other as indicated by the bold lines.

FIG. 12D illustrates an image that is formed on the sheet P in the case where the switching point Kp is set at a position behind the center of the region in which the LEDs 71 are arranged in rows in the main scanning direction. In this case, the switching point Kp is positioned behind the intersection of the straight line S1 and the straight line S2, and thus, portions of the image to be formed are not connected to each other at the switching point Kp and noncontiguous with each other as indicated by the bold lines.

In other words, in the case where the switching point Kp is positioned outside the center of the region in which the LEDs 71 are arranged in rows, portions of the image formed onto the sheet P become noncontiguous, and this leads to degradation of the image quality.

Accordingly, in the present exemplary embodiment, the occurrence of the above problem is suppressed by sequentially turning on the LEDs 71 in the joint portions 633 in the order in which the LEDs 71 are arranged and setting the turn-on direction in the first light-emitting-element row and the turn-on direction in the second light-emitting-element row to be the same as each other.

Figure 13A:
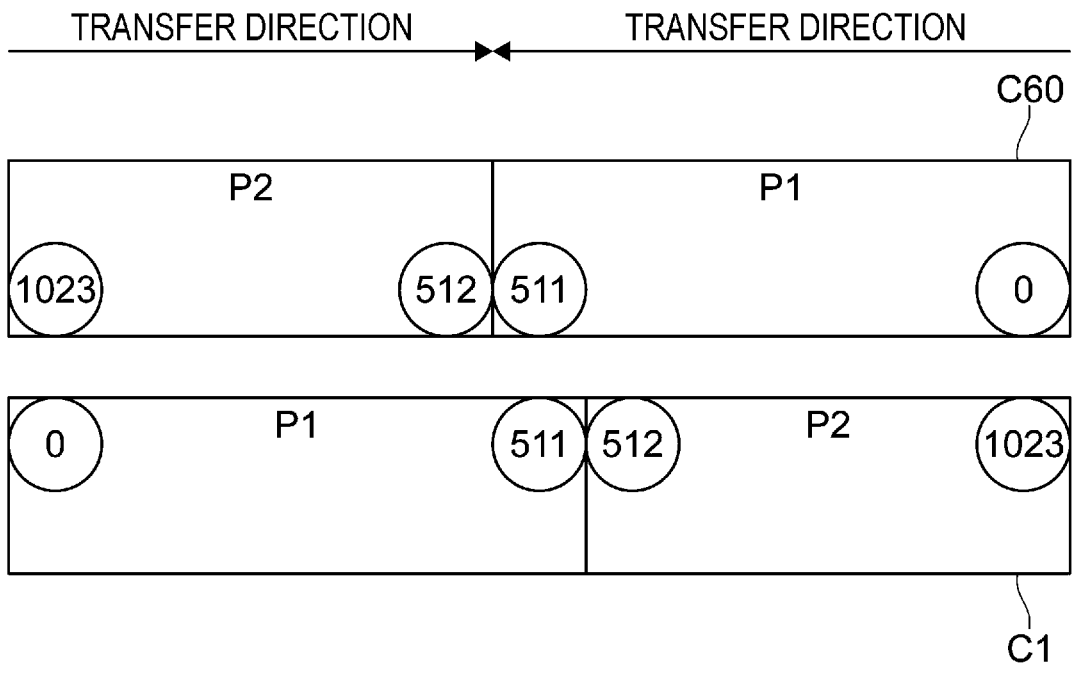
FIG. 13A is a diagram illustrating transfer directions set for the light emitting chips that are located in a joint portion.

FIG. 13A is a diagram illustrating transfer directions set for the light emitting chips C that are located in one of the joint portions 633.

In this case, in the joint portion 633, the LEDs 71 of the light emitting chip C60 that are included in the first light-emitting-element row and the LEDs 71 of the light emitting chip C1 that are included in the second light-emitting-element row are arranged in the subscanning direction. In each of the light emitting chips C60 and C1, the 1,024 LEDs 71 denoted by the numbers 0 to 1023 are aligned. The LEDs 71 denoted by the numbers 0 to 511 are arranged at the pitch P1, and the LEDs 71 denoted by the numbers 512 to 1023 are arranged at the pitch P2.

In each of the light emitting chips C60 and C1, the direction in which the LEDs 71 are sequentially turned on includes two opposite directions. In this case, each of the two directions is a direction from an end portion of the light emitting chip C toward the central region. Note that the turn-on directions are not limited to these, and each of the turn-on directions may be a direction from the central region toward the end portion.

The direction in which the LEDs 71 are sequentially turned on is changed from one of the two directions to the other at a boundary that is a point at which the pitch of the LEDs 71 is switched from one of the pitch P1 and the pitch P2 to the other.

Figure 13B:
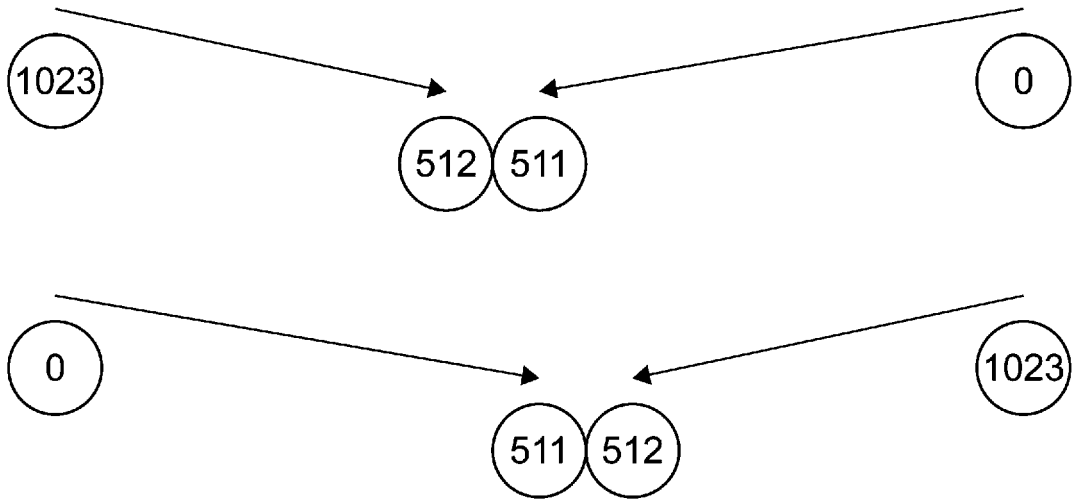
FIG. 13B is a diagram illustrating an image that is formed on a sheet when transfer directions such as those illustrated in FIG. 13A are set.

FIG. 13B is a diagram illustrating an image that is formed on one of the sheets P when transfer directions such as those illustrated in FIG. 13A are set.

As illustrated in FIG. 13B, in the subscanning direction, the displacement amount in the light emitting chip C60 and the displacement amount in the light emitting chip C1 are approximately equal to each other. In other words, the transfer directions in the light emitting chip C60 are the same as those in the light emitting chip C1, and thus, the displacement amounts in the subscanning direction are approximately equal to each other. As a result, the image does not become misaligned in the subscanning direction regardless of the position of the switching point Kp, and degradation of the image quality does not occur.

Note that from the standpoint of suppressing misalignment in the subscanning direction, it is not necessary to use the light emitting chip C in which the pitch of the LEDs 71 is switched from the pitch P1 to the pitch P2 in the central region of the region in which the LEDs 71 are arranged in rows such as that illustrated in FIG. 8. In other words, the light emitting chip C in which the pitch of the LEDs 71 does not change may be used. In the case where the pitch of the LEDs 71 does not change, the pitch of the LEDs 71 may be set to, for example, the pitch P1.

In the above case, although each of the light-emitting element heads 14 included in the image forming apparatus 1 have been described as a light emitting device, the present disclosure is not limited to this.

Figure 14:
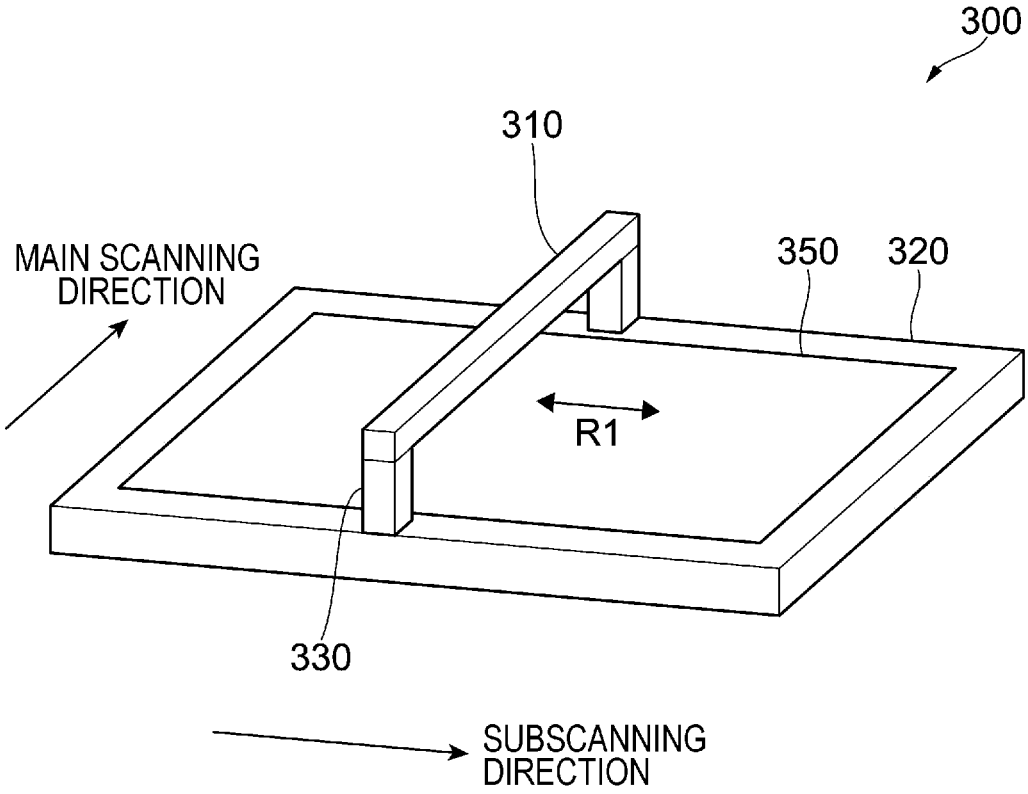
FIG. 14 is a diagram illustrating another example of a light emitting device.

FIG. 14 is a diagram illustrating another example of the light emitting device.

The light emitting device illustrated in FIG. 14 is an exposure head 310 that performs light exposure on a planar exposure surface. The exposure head 310 is included in an exposure device 300.

For example, the exposure device 300 is used for light exposure of a dry film resist (DFR) in a process of manufacturing a printed wiring board (PWB), formation of a color filter in a process of manufacturing a liquid crystal display (LCD), light exposure of a DFR in a process of manufacturing a thin film transistor (TFT), or light exposure of a DFR in a process of manufacturing a plasma display panel (PDP).

The exposure device 300 includes, in addition to the exposure head 310, an exposure table 320 on which a substrate 350 is placed and a moving mechanism 330 that moves the exposure head 310.

The exposure head 310 has a configuration similar to that of each of the above-described light-emitting element heads 14. In other words, the exposure head 310 includes the light emitting unit 63 including the plurality of LEDs 71, the circuit board 62 on which the light emitting unit 63, the signal generation circuit 100, and so forth are mounted, and the rod lens array 64 that focuses the light outputs emitted by the LEDs 71. The light emitting unit 63 includes the LPH bars 631, the focus adjustment pins 632, and the signal generation circuit 100.

The exposure table 320 is a placement table on which the substrate 350, which is a target of light exposure, is placed. The above-mentioned DFR is placed on the substrate 350, and light exposure is performed on the substrate 350.

As illustrated in FIG. 14, the moving mechanism 330 causes the exposure head 310 to reciprocate in a direction that is indicated by double-headed arrow R1 and that is parallel to the subscanning direction. As a result, the exposure head 310 scans the DFR or the like in the main scanning direction and also scans the DFR or the like in the subscanning direction by being moved.

Note that, although the exposure head 310 is moved in this case, the light exposure may be performed by moving the exposure table 320 in the subscanning direction.

Figure 15:
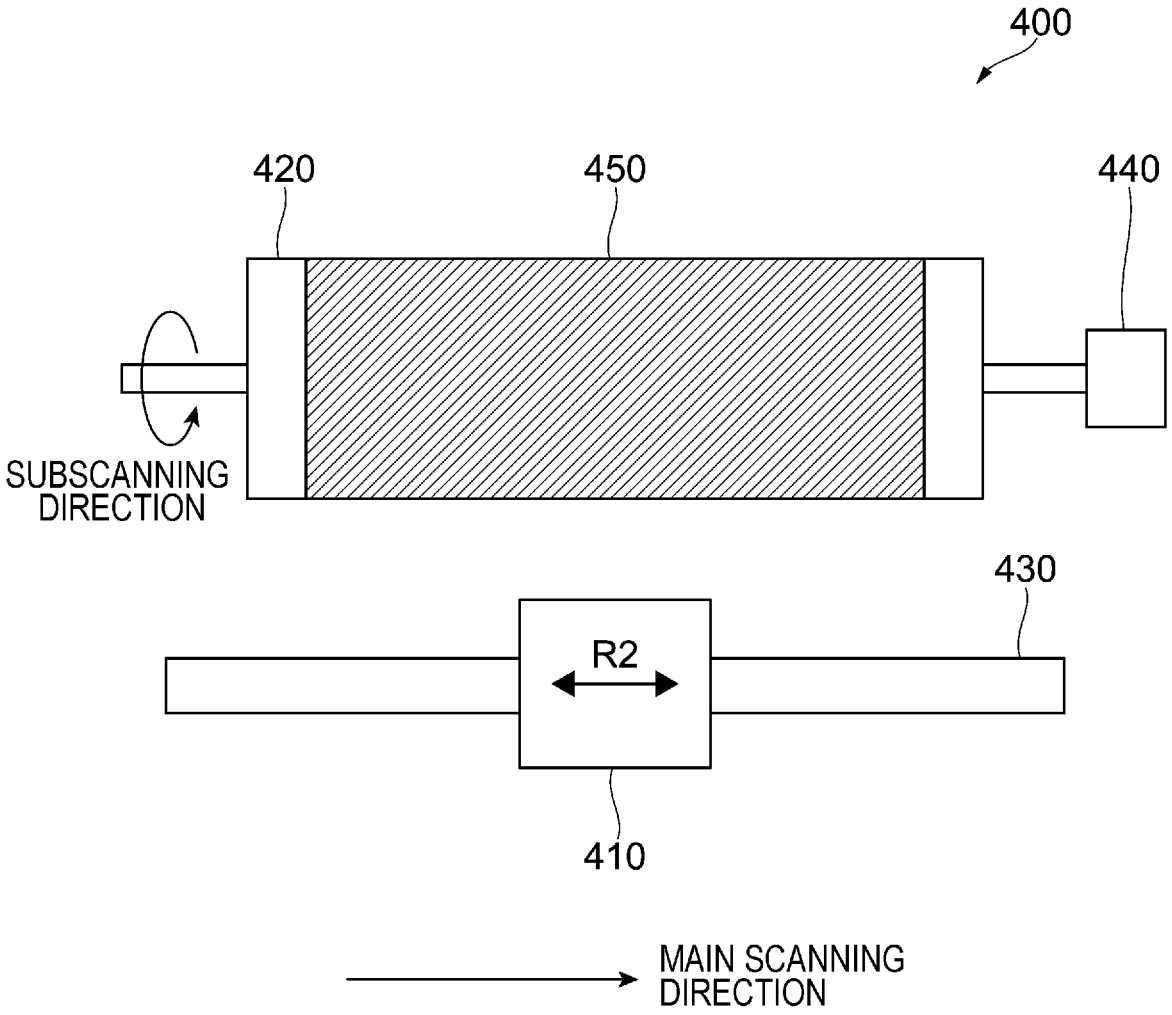
FIG. 15 is a diagram illustrating another example of the light emitting device.

FIG. 15 is a diagram illustrating another example of the light emitting device.

The light emitting device illustrated in FIG. 15 is an exposure head 410 that performs light exposure on an exposure surface having a curved shape. The exposure head 410 is included in an image recording apparatus 400.

The image recording apparatus 400 is, for example, a computer-to-plate (CTP) image output device that performs an image recording operation directly onto a recording material.

The image recording apparatus 400 includes, in addition to the exposure head 410, a rotary drum 420 that holds a recording material 450, a moving mechanism 430 that moves the exposure head 410, and a rotation mechanism 440 that rotates the rotary drum 420.

The exposure head 410 has a configuration similar to that of each of the above-described light-emitting element heads 14.

By rotating the rotary drum 420, the recording material 450 is rotated along with the rotary drum 420.

The moving mechanism 430 causes the exposure head 410 to reciprocate in a direction that is indicated by double-headed arrow R2 and that is parallel to the main scanning direction, so that the exposure head 410 performs a scanning operation in the main scanning direction. The moving mechanism 430 is, for example, a linear motor.

The rotation mechanism 440 rotates the rotary drum 420, so that the recording material 450 is moved in the subscanning direction so as to be exposed to light.

Note that although the single exposure head 410 is provided in this case, a plurality of exposure heads 410 may be provided so as to share the scanning operation in the main scanning direction.

Various applications of the present exemplary embodiment such as direct writing onto a printed circuit board or the like may be considered.

For example, one of the light-emitting element heads 14 of the present exemplary embodiment may be used as a flatbed exposure device including a stage that has a flat plate-like shape and that holds a sheet-shaped recording material or photosensitive material (e.g., a printed circuit board) by attracting it onto a surface thereof or may be used as a so-called outer-drum exposure device including a drum around which a recording material or a photosensitive material (e.g., a flexible printed circuit board) is wound. One of the above-described light-emitting element heads 14 may be applied to a device capable of rotating in a circumferential direction (main scanning direction) by positioning the light-emitting element head 14 in the axial direction of a rotary drum, which holds a photosensitive material, (subscanning direction) and causing the rotary drum by a driving mechanism to rotate about its axis. In this manner, one of the light-emitting element heads 14 may be used as a computer-to-plate (CTP) exposure device that performs light exposure directly onto a plate material.

For example, the above-described light-emitting element heads 14 may be used for applications such as light exposure of a dry film resist (DFR) in a process of manufacturing a printed wiring board (PWB), formation of a color filter in a process of manufacturing a liquid crystal display (LCD), light exposure of a DFR in a process of manufacturing a TFT, and light exposure of a DFR in a process of manufacturing a plasma display panel (PDP).

In addition, for each of the above-described light-emitting element heads 14, either a photon-mode photosensitive material on which information is directly recorded by light exposure or a heat-mode photosensitive material on which information is recorded by using heat generated by light exposure may be used. In the case of using a photon-mode photosensitive material, a GaN-based semiconductor laser, a wavelength-conversion solid-state laser, or the like is used as a laser device, and in the case of using a heat-mode photosensitive material, an AlGaAs-based semiconductor laser (an infrared laser) or a solid-state laser is used as a laser device.

The entire image forming apparatus 1 may be considered as a light emitting device.

Although the exemplary embodiment of the present disclosure has been described above, the technical scope of the present disclosure is not limited to the scope described in the above exemplary embodiment. It is obvious from the description of the claims that other exemplary embodiments obtained by making various changes and improvements to the above-described exemplary embodiment are also within the technical scope of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A light emitting device comprising:

a first light-emitting-element row that includes light emitting elements arranged in a row in a main scanning direction;

a second light-emitting-element row that includes light emitting elements arranged in a row in the main scanning direction and that is positioned in such a manner that at least a portion of the second light-emitting-element row overlaps the first light-emitting-element row in a subscanning direction; and a light-emission control unit that switches a light-emitting-element row caused to emit light between the first light-emitting-element row and the second light-emitting-element row at a switching point that is set at a position in an overlapping portion in which the first light-emitting-element row and the second light-emitting-element row overlap each other, wherein the light-emission control unit sequentially turns on the light emitting elements in the overlapping portion in the order in which the light emitting elements are arranged and sets a first direction in which the light emitting elements in a first portion of the first light-emitting-element row are sequentially turned on and the light emitting elements in a first portion of the second light-emitting-element row are sequentially turned on, and sets a second direction in which the light emitting elements in a second portion of the first light-emitting-element row are sequentially turned on and the light emitting elements in a second portion of the second light-emitting-element row are sequentially turned on, wherein the first direction and second direction are opposite directions.

2. The light emitting device according to claim 1, wherein the first light-emitting-element row and the second light-emitting-element row are each formed by arranging light-emitting-element array chips each of which is formed of light emitting elements arranged in a row in the main scanning direction, and wherein, in each of the light-emitting-element array chips, a pitch of the light emitting elements arranged in a row is changed from a first pitch to a second pitch, which is different from the first pitch, in a central region of the row of the light emitting elements.

3. The light emitting device according to claim 2, wherein the light emitting elements arranged at the first pitch in a first light-emitting-element array chip and the light emitting elements arranged at the second pitch in a second light-emitting-element array chip face each other in at least a portion of the overlapping portion.

4. The light emitting device according to claim 3, wherein the light-emitting-element row caused to emit light is switched between the first light-emitting-element row and the second light-emitting-element row at a point that is set at a position in the overlapping portion at which the light emitting elements forming the first light-emitting-element row and the light emitting elements forming the second light-emitting-element row are aligned in the subscanning direction.

5. The light emitting device according to claim 4, wherein, in each of the light-emitting-element array chips, the pitch of the light emitting elements is switched from the first pitch to the second pitch, which is different from the first pitch, and wherein the direction in which the light emitting elements are sequentially turned on is changed from one of the two directions to the other at a boundary that is a point at which the pitch of the light emitting elements is switched from one of the first pitch and the second pitch to the other.

6. An image forming apparatus comprising:

the light emitting device according to claim 1, configured to emit light to form an electrostatic latent image for forming an toner image;

a transfer unit that transfers the toner image onto a recording medium; and a fixing unit that fixes the toner image transferred to the recording medium onto the recording medium so as to form an image.

7. An exposure device comprising:

the emitting device according to claim 1; and an optical element that is used for forming an electrostatic latent image by focusing a light output of a light emitting element and exposing a photoconductor to light.

8. A light emitting device comprising:

a first light-emitting-element row that includes light emitting elements arranged in a row in a main scanning direction;

a second light-emitting-element row that includes light emitting elements arranged in a row in the main scanning direction and that is positioned in such a manner that at least a portion of the second light-emitting-element row overlaps the first light-emitting-element row in a subscanning direction; and light-emission control means for switching a light-emitting-element row caused to emit light between the first light-emitting-element row and the second light-emitting-element row at a switching point that is set at a position in an overlapping portion in which the first light-emitting-element row and the second light-emitting-element row overlap each other, wherein the light-emission control means sequentially turns on the light emitting elements in the overlapping portion in the order in which the light emitting elements are arranged and sets a first direction in which the light emitting elements in a first portion of the first light-emitting-element row are sequentially turned on and the light emitting elements in a first portion of the second light-emitting-element row are sequentially turned on, and sets a second direction in which the light emitting elements in a second portion of the first light-emitting-element row are sequentially turned on and the light emitting elements in a second portion of the second light-emitting-element row are sequentially turned on, wherein the first direction and second direction are opposite directions.

* * * * *